US008600276B2

(12) United States Patent
Ishii et al.

(10) Patent No.: US 8,600,276 B2
(45) Date of Patent: Dec. 3, 2013

(54) HEAT CONDUCTION UNIT, FIXING DEVICE, AND IMAGE FORMING APPARATUS

(75) Inventors: Kenji Ishii, Kanagawa-ken (JP); Masaaki Yoshikawa, Tokyo (JP); Tetsuo Tokuda, Kanagawa-ken (JP); Yoshiki Yamaguchi, Kanagawa-ken (JP); Kenichi Hasegawa, Kanagawa-ken (JP); Yutaka Ikebuchi, Kanagawa-ken (JP); Akira Shinshi, Tokyo (JP); Naoki Iwaya, Tokyo (JP); Takamasa Hase, Kanagawa-ken (JP); Takahiro Imada, Kanagawa-ken (JP); Toshihiko Shimokawa, Kanagawa-ken (JP); Ippei Fujimoto, Kanagawa-ken (JP); Hiroshi Yoshinaga, Chiba-ken (JP); Shuntaroh Tamaki, Kanagawa-ken (JP)

(73) Assignee: Ricoh Company, Limited, Tokyo (JP)

( * ) Notice: Subject to any disclaimer, the term of this patent is extended or adjusted under 35 U.S.C. 154(b) by 282 days.

(21) Appl. No.: 13/014,306

(22) Filed: Jan. 26, 2011

(65) Prior Publication Data

US 2011/0182638 A1 Jul. 28, 2011

(30) Foreign Application Priority Data

Jan. 27, 2010 (JP) ..... 2010-015541
Feb. 18, 2010 (JP) ..... 2010-033803

(51) Int. Cl.
*G03G 15/20* (2006.01)

(52) U.S. Cl.
USPC ..... 399/329

(58) Field of Classification Search
USPC ..... 399/329, 328, 122
See application file for complete search history.

(56) References Cited

U.S. PATENT DOCUMENTS 6,131,009 A 10/2000 Hasegawa
6,496,666 B2 12/2002 Hayashi et al.

(Continued)

FOREIGN PATENT DOCUMENTS

JP 10-213984 8/1998
JP 2884714 2/1999

(Continued)

OTHER PUBLICATIONS

Japanese Office Action dated Sep. 3, 2013 for corresponding Japanese patent application No. 2010-015541.

(Continued)

*Primary Examiner* — Walter L Lindsay, Jr.
*Assistant Examiner* — Rodney Bonnette
(74) *Attorney, Agent, or Firm* — Oblon, Spivak, McClelland, Maier & Neustadt, L.L.P.

(57) ABSTRACT

A heat conduction unit includes a flexible endless belt, a heat conductor disposed in proximity to an inner circumferential face of the endless belt and having a cross-section substantially identical to a cross-section of the endless belt, a heat source that heats the heat conductor to heat the endless belt, a pressing roller disposed opposite the heat conductor to rotate the endless belt in accordance with rotation of the pressing roller, a nip formation member disposed opposite the pressing roller and within a loop formed by the endless belt to form a nip between the endless belt and the pressing roller, and a pushing member disposed within the loop to support the nip formation member. The heat conductor has at least two different cross-sectional shapes perpendicular to a long direction of the heat conductor at different positions in the long direction of the heat conductor.

14 Claims, 11 Drawing Sheets

(56) References Cited

U.S. PATENT DOCUMENTS

| | | | |
|---|---|---|---|
| 6,591,081 | B2 | 7/2003 | Hasegawa |
| 6,628,916 | B2 | 9/2003 | Yasui et al. |
| 6,636,709 | B2 | 10/2003 | Furukawa et al. |
| 6,778,790 | B2 | 8/2004 | Yoshinaga et al. |
| 6,778,804 | B2 | 8/2004 | Yoshinaga et al. |
| 6,785,505 | B2 | 8/2004 | Yasui et al. |
| 6,813,464 | B2 | 11/2004 | Amita et al. |
| 6,881,927 | B2 | 4/2005 | Yoshinaga et al. |
| 6,882,820 | B2 | 4/2005 | Shinshi et al. |
| 6,892,044 | B2 | 5/2005 | Yasui et al. |
| 6,937,827 | B2 | 8/2005 | Katoh et al. |
| 7,022,944 | B2 | 4/2006 | Yoshinaga et al. |
| 7,070,182 | B2 | 7/2006 | Hasegawa |
| 7,127,204 | B2 | 10/2006 | Satoh et al. |
| 7,151,907 | B2 | 12/2006 | Yoshinaga et al. |
| 7,239,838 | B2 | 7/2007 | Sato et al. |
| 7,242,897 | B2 | 7/2007 | Satoh et al. |
| 7,313,353 | B2 | 12/2007 | Satoh et al. |
| 7,330,682 | B2 | 2/2008 | Shinshi |
| 7,379,698 | B2 | 5/2008 | Yoshinaga |
| 7,437,111 | B2 | 10/2008 | Yamada et al. |
| 7,454,151 | B2 | 11/2008 | Satoh et al. |
| 7,466,949 | B2 | 12/2008 | Satoh et al. |
| 7,509,085 | B2 | 3/2009 | Yoshinaga et al. |
| 7,515,850 | B2 | 4/2009 | Hasegawa |
| 7,546,049 | B2 | 6/2009 | Ehara et al. |
| 7,570,910 | B2 | 8/2009 | Ishii |
| 7,593,680 | B2 | 9/2009 | Shinshi |
| 7,630,652 | B2 | 12/2009 | Hasegawa |
| 7,702,271 | B2 | 4/2010 | Yamada et al. |
| 7,742,714 | B2 | 6/2010 | Shinshi et al. |
| 7,783,240 | B2 | 8/2010 | Ito et al. |
| 7,796,933 | B2 | 9/2010 | Ueno et al. |
| 7,801,457 | B2 | 9/2010 | Seo et al. |
| 7,840,151 | B2 | 11/2010 | Fujimoto |
| 7,869,753 | B2 | 1/2011 | Shinshi |
| 8,213,827 | B2 | 7/2012 | Shinshi et al. |
| 8,311,469 | B2 | 11/2012 | Yoshikawa et al. |
| 8,346,117 | B2 | 1/2013 | Ishii et al. |
| 8,364,048 | B2 | 1/2013 | Iwaya et al. |
| 8,364,052 | B2 | 1/2013 | Iwaya et al. |
| 2006/0029411 | A1 | 2/2006 | Ishii et al. |
| 2006/0257183 | A1 | 11/2006 | Ehara et al. |
| 2007/0003334 | A1 | 1/2007 | Shinshi et al. |
| 2007/0014600 | A1 | 1/2007 | Ishii et al. |
| 2007/0059071 | A1 | 3/2007 | Shinshi et al. |
| 2007/0292175 | A1 | 12/2007 | Shinshi |
| 2008/0063443 | A1 | 3/2008 | Yoshinaga et al. |
| 2008/0112739 | A1 | 5/2008 | Shinshi |
| 2008/0175633 | A1 | 7/2008 | Shinshi |
| 2008/0253788 | A1 | 10/2008 | Shinshi |
| 2008/0253789 | A1 | 10/2008 | Yoshinaga et al. |
| 2008/0298862 | A1 | 12/2008 | Shinshi |
| 2008/0317532 | A1 | 12/2008 | Ehara et al. |
| 2009/0067902 | A1 | 3/2009 | Yoshinaga et al. |
| 2009/0123201 | A1 | 5/2009 | Ehara et al. |
| 2009/0123202 | A1 | 5/2009 | Yoshinaga et al. |
| 2009/0148204 | A1 | 6/2009 | Yoshinaga et al. |
| 2009/0148205 | A1 | 6/2009 | Seo et al. |
| 2009/0162115 | A1* | 6/2009 | Kobayashi ..... 399/329 |
| 2009/0169232 | A1 | 7/2009 | Kunii et al. |
| 2009/0245865 | A1 | 10/2009 | Shinshi et al. |
| 2009/0245897 | A1 | 10/2009 | Seo et al. |
| 2009/0297197 | A1 | 12/2009 | Hase |
| 2009/0311016 | A1 | 12/2009 | Shinshi |
| 2009/0324266 | A1* | 12/2009 | Kobayashi ..... 399/45 |
| 2010/0061753 | A1 | 3/2010 | Hase |
| 2010/0074667 | A1 | 3/2010 | Ehara et al. |
| 2010/0092220 | A1 | 4/2010 | Hasegawa et al. |
| 2010/0092221 | A1 | 4/2010 | Shinshi et al. |
| 2010/0202809 | A1 | 8/2010 | Shinshi et al. |
| 2010/0290822 | A1 | 11/2010 | Hasegawa et al. |
| 2010/0303521 | A1 | 12/2010 | Ogawa et al. |
| 2011/0013950 | A1 | 1/2011 | Furuya et al. |
| 2011/0026987 | A1 | 2/2011 | Hasegawa |
| 2011/0044734 | A1 | 2/2011 | Shimokawa et al. |
| 2011/0052237 | A1 | 3/2011 | Yoshikawa et al. |
| 2011/0052277 | A1 | 3/2011 | Satoshi et al. |
| 2011/0052282 | A1 | 3/2011 | Shinshi et al. |
| 2011/0058862 | A1 | 3/2011 | Yamaguchi et al. |
| 2011/0058863 | A1 | 3/2011 | Shinshi et al. |
| 2011/0058864 | A1 | 3/2011 | Fujimoto et al. |
| 2011/0058865 | A1 | 3/2011 | Tokuda et al. |
| 2011/0058866 | A1 | 3/2011 | Ishii et al. |
| 2011/0064437 | A1 | 3/2011 | Yamashina et al. |
| 2011/0064451 | A1 | 3/2011 | Yamaguchi et al. |
| 2011/0064490 | A1 | 3/2011 | Imada et al. |
| 2011/0064502 | A1 | 3/2011 | Hase et al. |
| 2011/0076071 | A1 | 3/2011 | Yamaguchi et al. |
| 2011/0085832 | A1 | 4/2011 | Hasegawa et al. |
| 2011/0116848 | A1 | 5/2011 | Yamaguchi et al. |
| 2011/0129268 | A1 | 6/2011 | Ishii et al. |
| 2011/0200368 | A1* | 8/2011 | Yamaguchi et al. ..... 399/328 |
| 2011/0200369 | A1* | 8/2011 | Shinshi ..... 399/329 |

FOREIGN PATENT DOCUMENTS

| | | |
|---|---|---|
| JP | 2001-66933 | 3/2001 |
| JP | 3298354 | 4/2002 |
| JP | 2003-257592 | 9/2003 |
| JP | 3592485 | 9/2004 |
| JP | 2005-24725 | 1/2005 |
| JP | 3993983 | 8/2007 |
| JP | 2007-334205 | 12/2007 |
| JP | 2008-70582 | 3/2008 |
| JP | 2008-146010 | 6/2008 |
| JP | 2008-158482 | 7/2008 |
| JP | 2008-191258 | 8/2008 |
| JP | 2008-216928 | 9/2008 |
| JP | 2008-310051 | 12/2008 |
| JP | 2009-116128 | 5/2009 |
| JP | 2009-151115 | 7/2009 |

OTHER PUBLICATIONS

Japanese Office Action dated Sep. 3, 2013 for corresponding Japanese patent application No. 2010-033803.

* cited by examiner

FIG. 13
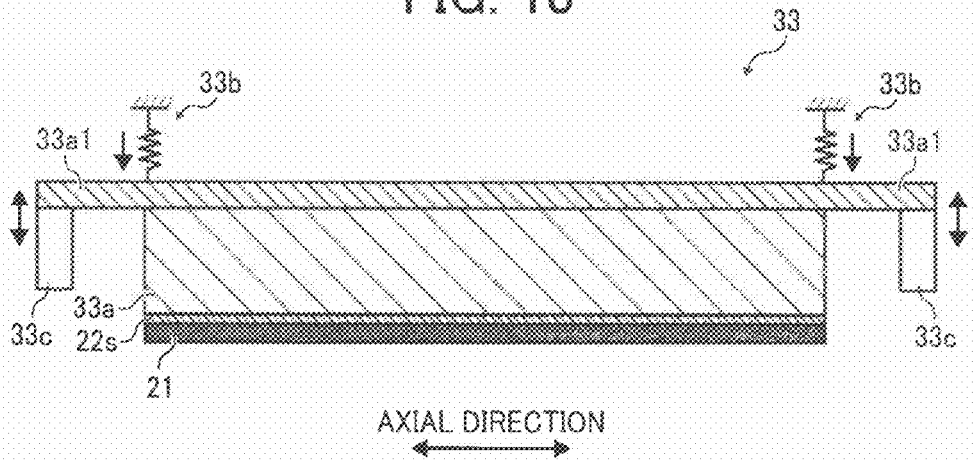
FIG. 14A
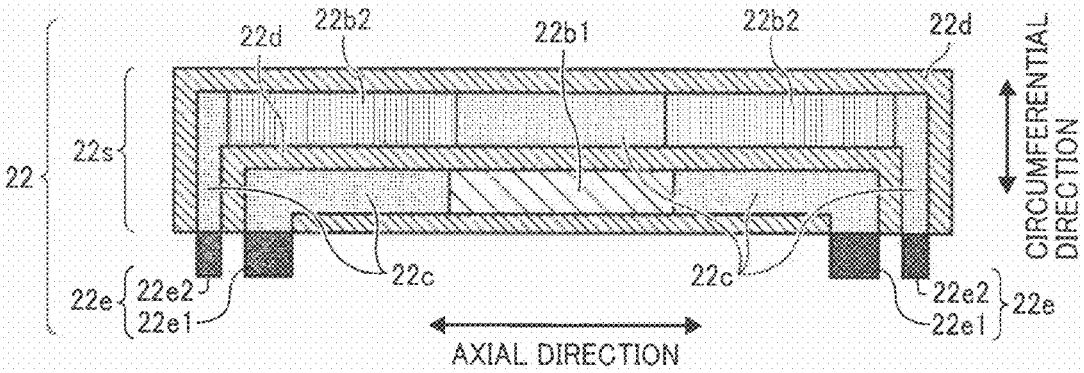
FIG. 14B
MATRIX ELEMENTS OF SEGMENTS
| | | |
|---|---|---|
| (2, 1) | (2, 2) | (2, 3) |
| (1, 1) | (1, 2) | (1, 3) |

HEAT CONDUCTION UNIT, FIXING DEVICE, AND IMAGE FORMING APPARATUS

CROSS-REFERENCE TO RELATED APPLICATIONS

The present patent application claims priority pursuant to 35 U.S.C. §119 from Japanese Patent Application Nos. 2010-015541, filed on Jan. 27, 2010 and 2010-033803, filed on Feb. 18, 2010 in the Japan Patent Office, each of which is incorporated herein by reference in its entirety.

BACKGROUND OF THE DISCLOSURE

1. Field of the Disclosure

Exemplary embodiments of the present disclosure relate to a heat conduction unit, a fixing device, and an electrophotographic or electrostatic image forming apparatus, such as a facsimile, printer, copier, or multifunction devices having at least two of the foregoing capabilities.

2. Description of the Background Art

As one type of image forming apparatus, electrophotographic image forming apparatuses are widely known. In an image formation process executed by an electrophotographic image forming apparatus, for example, a charger uniformly charges a surface of an image carrier (e.g., photoconductor drum); an optical writing unit emits a light beam onto the charged surface of the image carrier to form an electrostatic latent image on the image carrier according to image data; a development device supplies toner to the electrostatic latent image formed on the image carrier to make the electrostatic latent image visible as a toner image; the toner image is directly transferred from the image carrier onto a recording medium, such as a recording sheet, or indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device includes, e.g., a rotational fixing unit formed with a roller, a belt, or a combination of a roller and a belt. The fixing device sandwiches a recording medium at a fixing nip and applies heat and pressure to a toner image on the recording sheet to fix the toner image on the recording medium. Several types of fixing devices are conventionally known, including, for example, a belt-type fixing device.

FIG. 1 is a schematic view illustrating a conventional belt-type fixing device configuration. In FIG. 1, the belt-type fixing device includes a heating roller 102, a fixing roller 104, a fixing belt 101, and a pressing roller 109. The heating roller 102 includes a heater 103. The fixing roller 104 includes a rubber layer on its surface. The fixing belt 101 is stretched between the heating roller 102 and the fixing roller 104. The pressing roller 109 presses against the fixing roller 104 via the fixing belt 101 to form a fixing nip N. When a toner image is transferred onto a recording medium P, the recording medium P is conveyed to the fixing nip N between the fixing belt 101 and the pressing roller 109. When the recording medium P passes the fixing nip N, heat and pressure are applied to the toner image on the recording medium P to fix the toner image on the recording medium P.

FIG. 2 is a schematic view illustrating a conventional film-type fixing device configuration. As described in JP-H04-044075-A, typically, a ceramic heater 113 and a pressing roller 119 sandwiches a heat-resistant film 111 (equivalent to the fixing belt) to form the fixing nip N. A recording sheet is fed to the fixing nip N between the heat-resistant film 111 and the pressing roller 119. Then, the recording sheet is sandwiched by the heat-resistant film 111 and the pressing roller 119 to be conveyed together with the heat-resistant film 111. At this time, at the fixing nip N, heat of the ceramic heater 113 is applied to the recording medium with pressure via the heat-resistant film 111 to fix a toner image on the recording medium.

At the same time, however, belt-type fixing devices are not problem-free. For the belt-type fixing device, a large heat capacity of the fixing roller increases the time required for raising the temperature of the fixing roller to the requisite level for good image formation, resulting in an increased warm-up time.

To cope with such challenges, for example, JP-2007-334205-A proposes a fixing device that can shorten the warm-up time without increasing the heat capacity of the fixing belt. However, since the heat capacity of the typical pipe-shaped heat conductor is low, the heat conductor may be directly affected by the heat distribution of the heater. As a result, contact of the fixing belt and the heat conductor may change the temperature of the fixing belt.

In general, a uniform temperature distribution over the surface of the fixing belt is desirable. For the fixing device, the surface temperature distribution of the fixing belt may be affected by the heat distribution of the heater and the contact face of the heat conductor and the fixing belt, preventing uniform temperature distribution. Moreover, the fixing belt while rotating may be separated from the metal heat conductor at a certain position, such that heat from the metal heat conductor is not transferred to the fixing belt. Consequently, the metal heat conductor may be overheated, resulting in an increased rotation torque of the fixing belt. Additionally, the fixing device transfers heat of the resistant heat generator to an opposing member, resulting in a limitation in shortening of the warm-up time and/or the first print time.

To cope with such challenges, JP-2008-216928-A proposes a fixing device including an endless-shaped fixing belt, a pressing roller pressed against the fixing belt to form a nip through which the recording medium is conveyed, and a resistant heat generator provided inside a loop formed by the fixing belt to heat the fixing belt. The resistant heat generator is provided slightly away from the inner circumferential face of the fixing belt so as not to press against the inner circumferential face of the fixing belt, and the fixing belt is entirely heated by radiation heat radiated from the resistant heat generator.

However, for the fixing device, since the fixing belt is positioned adjacent to the resistant heat generator to suppress a reduction in heating efficiency, a portion of the flexible fixing belt while rotating may come into contact with the resistant heat generator. As a result, heat from the resistant heat generator is transferred to the contact portion of the fixing belt. Thus, the fixing belt is heated in a non-uniform manner, resulting in non-uniform temperature distribution over the surface of the fixing belt.

Further, there is another consideration. It is generally presupposed that different types of recording media pass through the fixing device, or, put differently, that the apparatus incorporating the fixing device can accommodate recording media of multiple different sizes. For example, assume that a relatively small recording medium smaller than an axial width of a heat generation area of a heater for heating the fixing member passes through the fixing device. In this state, since heat from an area of the fixing member over which the sheet of recording media does not pass (typically the axial end portions of the fixing member) is not absorbed by the recording media, these end portions may get overheated (i.e., the temperature may increase excessively), degrading the fixing member and reducing product life.

Hence, JP-2008-310051-A proposes a fixing device in which multiple heat sources (e.g., halogen heaters, planar heat generators, or electromagnetic induction heaters) having different heating distributions in the width direction of the recording media are provided as heaters and power is supplied only to at least one of the heat sources compatible with the sheet pass width of the recording medium to prevent temperature increase in the end portions of the fixing member.

Although successful for its intended purpose, the fixing device of JP-2008-310051-A has limitations on the sizes of the recording media that it can accommodate because the width of the heat generation area can be adjusted only by changing the number of heat sources. Further, although the fixing device described in JP-2008-216928-A has a plurality of resistant heat generators arranged in an axial direction of the fixing belt and the resistant heat generators are controlled independently, so that the heating distribution in the axial direction of the fixing belt can be adjusted, nevertheless the fixing device also has a limitation in flexible response to different sizes of recording media.

SUMMARY

In an aspect of this disclosure, there is provided an improved heat conduction unit including a flexible endless belt, a heat conductor, a heat source, a pressing roller, a nip formation member, and a pushing member. The heat conductor is disposed in proximity to an inner circumferential face of the endless belt and has a cross section substantially identical to a cross section of the endless belt. The heat source heats the heat conductor to heat the endless belt. The pressing roller is disposed opposite the heat conductor to rotate the endless belt in accordance with rotation of the pressing roller. The nip formation member is disposed opposite the pressing roller and within a loop formed by the endless belt to form a nip between the endless belt and the pressing roller. The pushing member is disposed within the loop formed by the endless belt to support the nip formation member. The heat conductor has at least two different cross-sectional shapes perpendicular to a long direction of the heat conductor at different positions in the long direction of the heat conductor.

In an aspect of this disclosure, there is provided an improved fixing device including the heat conduction unit described above.

In an aspect of this disclosure, there is provided an improved image forming apparatus including the fixing device described above.

In an aspect of this disclosure, there is provided an improved fixing device including an endless-shaped rotational fixing member, a pressing member, a contact member, a planar heat generator, and a heat generator moving unit. The pressing member is pressed against an outer circumferential face of the fixing member. The contact member is disposed inside the fixing member to contact the pressing member with the fixing member interposed between the contact member and the pressing member to form a nip. The planar heat generator is disposed so as to be contactable with an inner circumferential face of the fixing member to heat the fixing member. The heat generator moving unit includes a movable heat generator support member. The heat generator support member is disposed inside the fixing member so as to sandwich the planar heat generator between the heat generator support member and the fixing member to support the planar heat generator. The heat generator moving unit moves the heat generator support member in a direction to push or separate the heat generator support member against or from the inner circumferential face of the fixing member to press or separate the planar heat generator against or from the fixing member.

In an aspect of this disclosure, there is provided an improved image forming apparatus including the fixing device described above.

BRIEF DESCRIPTION OF THE DRAWINGS

Additional aspects, features, and advantages of the present disclosure will be readily ascertained as the same becomes better understood by reference to the following detailed description when considered in connection with the accompanying drawings, wherein:

FIG. 13 is a schematic cross-sectional view of a configuration of a heat-generator moving unit in an axial direction of the fixing device;

FIG. 14A is a schematic view of another configuration of a heat generation sheet;

FIG. 14B is a table showing matrix components of segments;

Figure 1:
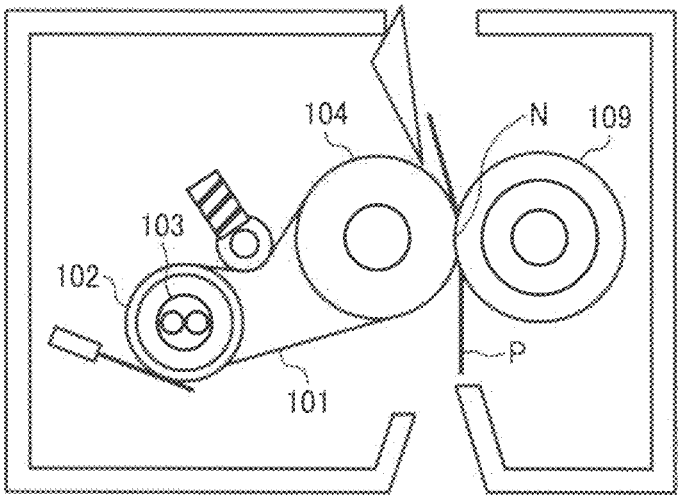
FIG. 1 RELATED ART
FIG. 1 is a schematic view of a conventional belt-fixing device configuration.
Figure 2:
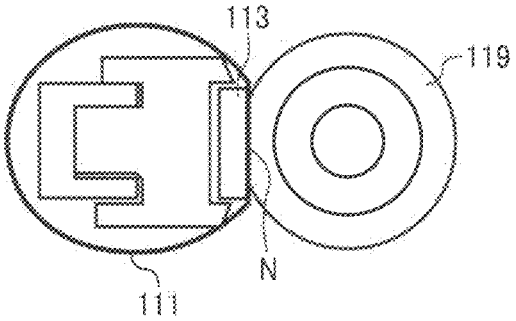
FIG. 2 RELATED ART
FIG. 2 is a schematic view of a conventional film-fixing device configuration.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Figure 3:
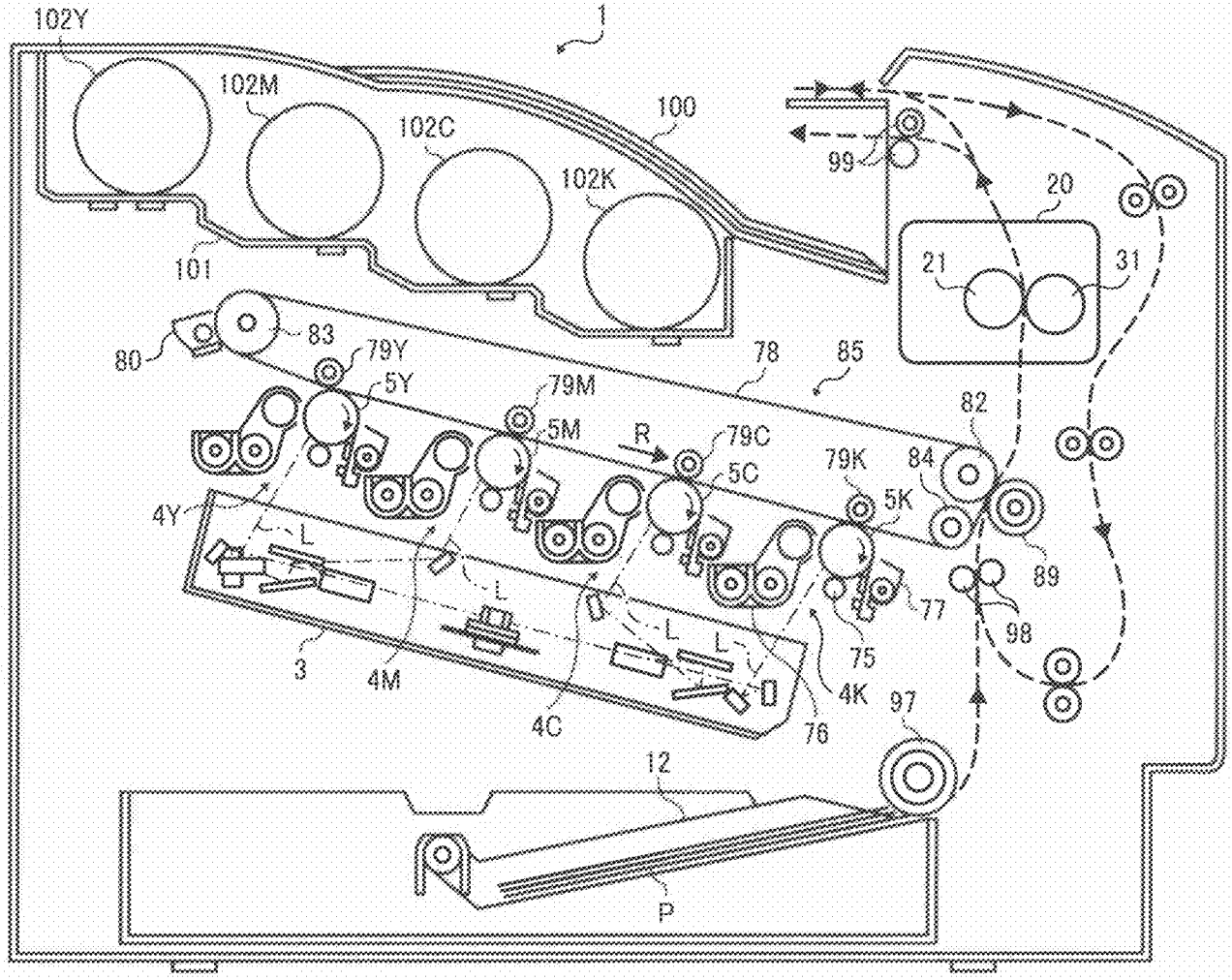
FIG. 3 is a schematic view of an image forming apparatus according to an exemplary embodiment of the present disclosure.

Referring now to the drawings, wherein like reference numerals designate identical or corresponding parts throughout the several views, in particular to FIG. 3, an image forming apparatus 1 according to an exemplary embodiment of the present disclosure is described.

FIG. 3 is a schematic configuration view of an image forming apparatus 1 according to an exemplary embodiment. In FIG. 3, the image forming apparatus 1 is a tandem color printer that forms a color image on a recording medium. However, it is to be noted that the image forming apparatus 1 is not limited to the tandem color printer and may be a copier, a facsimile machine, a printer, or a multifunctional device having at least two of the foregoing capabilities.

As illustrated in FIG. 3, a toner bottle holder 101 is provided in an upper portion of the image forming apparatus 1. Four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

An intermediate transfer unit 85 is provided below the toner bottle holder 101. Image forming devices 4Y, 4M, 4C, and 4K are arranged opposite an intermediate transfer belt 78 of the intermediate transfer unit 85, and form yellow, magenta, cyan, and black toner images, respectively.

The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, and cleaners 77Y, 77M, 77C, and 77K, respectively. Image forming processes including a charging process, an exposure process, a development process, a transfer process, and a cleaning process are performed on the photoconductive drums 5Y, 5M, 5C, and 5K to form yellow, magenta, cyan, and black toner images on the photoconductive drums 5Y, 5M, 5C, and 5K, respectively.

A driving motor drives and rotates the photoconductive drums 5Y, 5M, 5C, and 5K clockwise in FIG. 3. In the charging process, the chargers 75Y, 75M, 75C, and 75K uniformly charge surfaces of the photoconductive drums 5Y, 5M, 5C, and 5K at charging positions at which the chargers 75Y, 75M, 75C, and 75K are disposed opposite the photoconductive drums 5Y, 5M, 5C, and 5K, respectively.

In the exposure process, the exposure device 3 emits laser beams L onto the charged surfaces of the photoconductive drums 5Y, 5M, 5C, and 5K, respectively. In other words, the exposure device 3 scans and exposes the charged surfaces of the photoconductive drums 5Y, 5M, 5C, and 5K at irradiation positions at which the exposure device 3 is disposed opposite the photoconductive drums 5Y, 5M, 5C, and 5K to irradiate the charged surfaces of the photoconductive drums 5Y, 5M, 5C, and 5K to form thereon electrostatic latent images corresponding to yellow, magenta, cyan, and black colors, respectively.

In the development process, the development devices 5Y, 5M, 5C, and 5K render the electrostatic latent images formed on the surfaces of the photoconductive drums 76Y, 76M, 76C, and 76K visible as yellow, magenta, cyan, and black toner images at development positions at which the development devices 76Y, 76M, 76C, and 76K are disposed opposite the photoconductive drums 5Y, 5M, 5C, and 5K, respectively.

In the transfer process, first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78 at first transfer positions at which the first transfer bias rollers 79Y, 79M, 79C, and 79K are disposed opposite the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

In the cleaning process, cleaning blades included in the cleaners 77Y, 77M, 77C, and 77K mechanically collect the residual toner from the photoconductive drums 5Y, 5M, 5C, and 5K at cleaning positions at which the cleaners 77Y, 77M, 77C, and 77K are disposed opposite the photoconductive drums 5Y, 5M, 5C, and 5K, respectively.

Finally, dischargers remove residual potential on the photoconductive drums 5Y, 5M, 5C, and 5K at discharging positions at which the dischargers are disposed opposite the photoconductive drums 5Y, 5M, 5C, and 5K, respectively, thus completing a single sequence of image forming processes performed on the photoconductive drums 5Y, 5M, 5C, and 5K.

Accordingly, the yellow, magenta, cyan, and black toner images formed on the photoconductive drums 5Y, 5M, 5C, and 5K, respectively, are transferred and superimposed onto the intermediate transfer belt 78. Thus, a color toner image is formed on the intermediate transfer belt 78.

The intermediate transfer unit 85 includes the intermediate transfer belt 78, the first transfer bias rollers 79Y, 79M, 79C, and 79K, an intermediate transfer cleaner 80, a second transfer backup roller 82, a cleaning backup roller 83, and a tension roller 84. The intermediate transfer belt 78 is supported by and stretched over three rollers, which are the second transfer backup roller 82, the cleaning backup roller 83, and the tension roller 84. A single roller, that is, the second transfer backup roller 82, drives and endlessly moves (e.g., rotates) the intermediate transfer belt 78 in a direction R.

The four first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite to a polarity of toner forming the yellow, magenta, cyan, and black toner images on the photoconductive drums 5Y, 5M, 5C, and 5K, respectively.

Accordingly, the yellow, magenta, cyan, and black toner images formed on the photoconductive drums 5Y, 5M, 5C, and 5K, respectively, are transferred and superimposed onto the intermediate transfer belt 78 rotating in the direction R successively at the first transfer nips formed between the photoconductive drums 5Y, 5M, 5C, and 5K and the intermediate transfer belt 78 as the intermediate transfer belt 78 moves through the first transfer nips. Thus, a color toner image is formed on the intermediate transfer belt 78.

The color toner image formed on the intermediate transfer belt 78 reaches a second transfer nip. At the second transfer nip, the second transfer roller 89 and the second transfer backup roller 82 sandwich the intermediate transfer belt 78. The second transfer roller 89 transfers the color toner image formed on the intermediate transfer belt 78 onto a recording medium P fed by the registration roller pair 98 at the second transfer nip formed between the second transfer roller 89 and the intermediate transfer belt 78. After the transfer of the color toner image, residual toner, which has not been transferred onto the recording medium P, remains on the intermediate transfer belt 78.

Then, the intermediate transfer belt 78 reaches the position of the intermediate transfer cleaner 80. The intermediate transfer cleaner 80 collects the residual toner from the intermediate transfer belt 78 at a cleaning position at which the intermediate transfer cleaner 80 is disposed opposite the intermediate transfer belt 78, thus completing a single sequence of transfer processes performed on the intermediate transfer belt 78.

In this regard, the recording medium P is fed from a paper tray 12 to the second transfer nip via a feed roller 97 and a registration roller pair 98.

The paper tray 12 is provided in a lower portion of the image forming apparatus 1, and loads a plurality of recording media P (for example, transfer sheets). The feed roller 97 rotates counterclockwise in FIG. 3 to feed an uppermost recording medium P of the plurality of recording media P loaded on the paper tray 12 toward a roller nip formed between two rollers of the registration roller pair 98.

The registration roller pair 98, which stops rotating temporarily, stops the uppermost recording medium P fed by the feed roller 97 and reaching the registration roller pair 98. The registration roller pair 98 resumes rotating to feed the recording medium P to a second transfer nip, formed between the second transfer roller 89 and the intermediate transfer belt 78, as the color toner image formed on the intermediate transfer belt 78 reaches the second transfer nip. Thus, a color toner image is formed on the recording medium P.

The recording medium P bearing the color toner image is sent to a fixing device 20. In the fixing device 20, a fixing member 21 (for example, a fixing belt or sleeve) and a pressing roller 31 apply heat and pressure to the recording medium P to fix the color toner image on the recording medium P.

Thereafter, the fixing device 20 feeds the recording medium P bearing the fixed color toner image toward an output roller pair 99. The output roller pair 99 discharges the recording medium P to an outside of the image forming apparatus 1, that is, a stack portion 100. Thus, the recording media P discharged by the output roller pair 99 are stacked on the stack portion 100 successively to complete a single sequence of image forming processes performed by the image forming apparatus 1.

Next, a basic configuration of a fixing device according to an exemplary embodiment of the present disclosure is described with reference to a comparative example (i.e., a fixing device 20C1) illustrated in FIG. 4.

Figure 4:
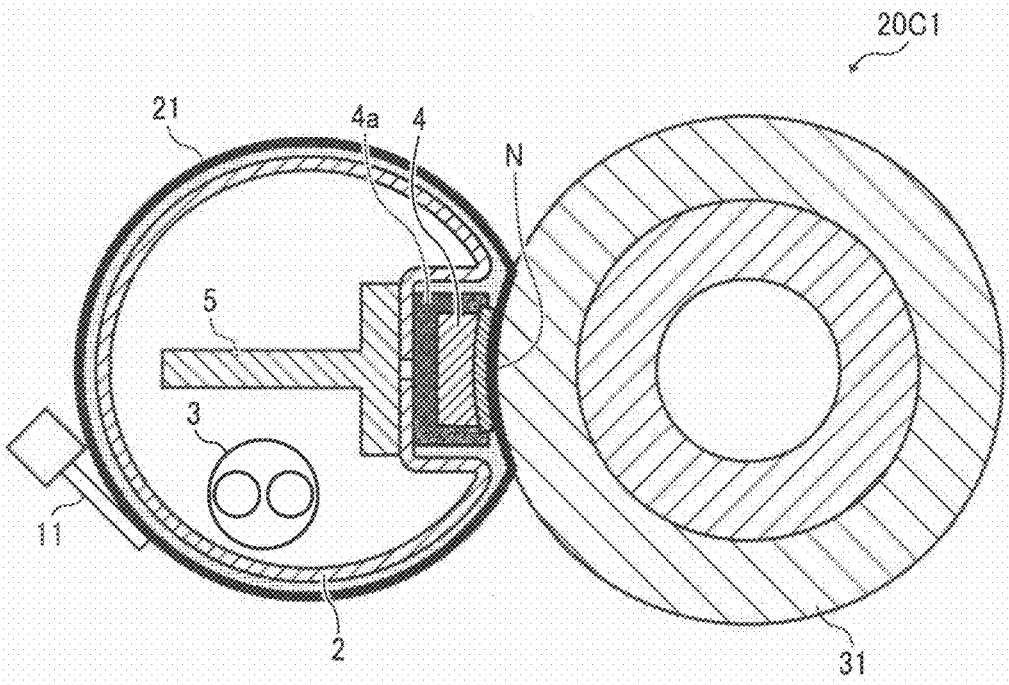
FIG. 4 is a schematic view of a fixing device according to a comparative example configuration.

Like the comparative example illustrated in FIG. 4, a fixing device according to an exemplary embodiment of the present disclosure includes a pressing roller 31 serving as a rotary pressing member, a fixing belt 21 serving as a fixing member, a heat conductor 2 serving as a substantially-cylindrical metal member in proximity to an inner circumferential surface of the fixing belt 21, and a heater (e.g., halogen heater) 3 disposed to heat the heat conductor 2.

A nip formation member 4 is held by the heat conductor 2 within a loop formed by the fixing belt 21 so as to slide against an inner surface of the fixing belt 21 directly or indirectly via a sliding sheet.

Like the comparative example illustrated in FIG. 4, a fixing nip N of the nip formation member 4 may be formed in a concave shape. Alternatively, the shape of the fixing nip N may be flat or any other suitable shape. However, in a case in which the shape of the fixing nip N is concave, a recording sheet is discharged from the fixing nip N in a direction close to the pressing roller 31. Accordingly, such a configuration allows the recording sheet to more easily separate from the fixing belt 21, thus preventing a sheet jam.

The pressing roller 31 includes a hollow metal roller having a silicone rubber layer. Further, a releasing layer, such as a perfluoroalkoxy (PFA) resin layer or a polytetrafluoroethylene (PTFE) resin layer, is formed on an outer surface of the pressing roller 31 to obtain good releasing property.

The pressing roller 31 is rotated by a driving force transmitted via, for example, a gear (train) from a driving source, such as a motor, disposed in the image forming apparatus 1. Further, the pressing roller 31 is pressed against the fixing belt 21 by a spring or other member. As a result, the rubber layer of the pressing roller 31 is compressed and deformed to form a certain width of the fixing nip N. It is to be noted that the pressing roller 31 may be formed of a solid roller. However, a hollow roller is preferable in that the heat capacity is relatively small. The pressing roller 31 may include a heat source such as a halogen heater.

The silicone rubber layer of the pressing roller 31 may be solid rubber. Alternatively, if the pressing roller 31 does not include a heater or other heat source, the silicone rubber layer may be made of sponge rubber. Sponge rubber is preferable in that the insulation performance is relatively high and thus less of the heat of the fixing belt 21 is removed by the pressing roller 31.

The fixing belt 21 has a thickness of approximately 25 μm to approximately 50 μm, and is a metal belt made of, for example, nickel or stainless steel or an endless belt or film made of polyimide or other resin. The fixing belt 21 has a surface release layer, such as a perfluoroalkoxy (PFA) resin layer or a polytetrafluoroethylene (PTFE) resin layer, to suppress adhesion of toner.

An elastic layer made of, for example, silicon rubber may be provided between the substrate of the fixing belt 21 and the surface release layer. In a case in which the elastic layer is not provided, the fixing performance can be enhanced. However, when a toner image is pressingly fixed from the fixing belt on a recording sheet, minute irregularities of the surface of the fixing belt may be transferred on the fixed toner image, resulting in rough imprint. To cope with such a failure, for example, a silicon rubber layer having a thickness of 100 um or greater may be provided as the elastic layer between the substrate of the fixing belt 21 and the surface release layer. Deformation of the silicon rubber layer can absorb the minute irregularities of the surface of the fixing belt, thus preventing roughening of a resultant image.

The heat conductor 2 of a hollow shape includes metal such as aluminum, iron, and/or stainless steel. The heat conductor 2 has a circular cross section having a diameter smaller than a diameter of the loop formed by the fixing belt by, for example, approximately 1 mm.

Inside the heat conductor 2 are provided the nip formation member 4, a heat insulator 4*a*, and a pushing member 5 that supports the heat insulator 4*a*. At this time, the pushing member 5 may be heated by, e.g., radiation heat from the heater 3. In such a case, the surface of the pushing member 5 may be insulated or mirror-finished to prevent the pushing member 5 from being heated. Such a configuration can prevent wasteful heat energy consumption.

It is to be noted that the heat source to heat the heat conductor 2 is not limited to a halogen heater and may be an induction heater, a resistant heater, a carbon heater, or any other suitable heater.

The fixing belt 21 rotates in accordance with rotation of the pressing roller 31. When the pressing roller 31 is rotated by a driving force of a driving source, the driving force is transmitted to the fixing belt 21 at the fixing nip N to rotate the fixing belt. The fixing belt 21 rotates while being sandwiched between the nip formation member 4 and the pressing roller 31 at the fixing nip N. At an area other than the fixing nip N, the fixing belt 21 is guided by the heat conductor 2 so as not to separate from the heat conductor 2 over a certain distance.

A lubricant is provided at an interface between the fixing belt 21 and the heat conductor 2 The surface roughness of the heat conductor 2 is greater than a particle diameter of the lubricant to effectively retain the lubricant. The surface of the heat conductor 2 is roughened by sandblasting or other physical processing, etching or other chemical processing, applying a coating material including small-diameter beads, or any other suitable processing.

Below, a fixing device according to an exemplary embodiment of the present disclosure is further described with reference to FIGS. 5A to 5D.

FIGS. 5A to 5D are schematic views of a fixing device 20 according to an exemplary embodiment of the present disclosure. In FIGS. 5A to 5D, the same reference characters are allocated to components corresponding to those of the above-described comparative example illustrated in FIG. 4 and redundant descriptions thereof are omitted below.

Figure 5A:
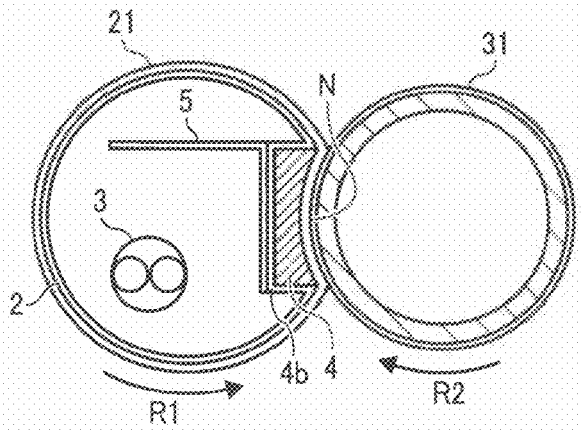
FIG. 5A is a schematic view of a fixing device according to an exemplary embodiment of the present disclosure.

As illustrated in FIG. 5A, the heat conductor 2 is formed by bending a flat plate so as to have a circular arc portion of a shape similar to the loop formed by the fixing belt 21 and a recessed portion 4*b* that holds the nip formation member 4. The heat conductor 2 is thin, for example, approximately 0.1 mm to approximately 0.3 mm in thickness to have a reduced thermal capacity, allowing reduction of the warm-up time. Since the heat conductor 2 is thin, the heat conductor 2 has low hardness and supports the fixing belt 21 while maintaining a desired flexibility.

The nip formation member 4 is formed of an elastic material, such as silicone rubber or fluorocarbon rubber. The nip formation member 4 has a curved face facing the pressing roller 31 and having a curvature similar to an outer-diameter curvature of the pressing roller 31 and is also supported by the heat conductor 2 with a heat insulator interposed between the nip formation member 4 and the heat conductor 2. An urging member, for example, a spring, urges the pressing roller 31 against the nip formation member 4 to form the fixing nip N.

The fixing belt 21 is rotated by surface friction resistance with the pressing roller 31 rotated by a driving source, such as a motor, to convey a recording sheet. The inner diameter of the fixing belt 21 is greater than the outer diameter of the heat conductor 2 by approximately 0.5 mm to approximately 1 mm. If the difference in diameter is too small, the sliding resistance between the fixing belt 21 and the heat conductor 2 may increase, resulting in an increased driving torque. Consequently, heat-resistance grease or other lubricant may be provided to reduce the sliding resistance. In such a configuration, low driving torque may not be stably obtained by, for example, degradation of grease in a long-term use. By contrast, if the difference in diameter is relatively great, the sliding resistance between the fixing belt 21 and the heat conductor 2 may decrease. However, an air layer may be formed between the heat conductor 2 and the fixing belt 21 may reduce heat conductivity, resulting in an increased time required to heat the surface temperature of the fixing belt 21 to a desired temperature or non-uniform distribution of the surface temperature of the fixing belt 21.

The fixing belt 21 rotates along the nip formation member 4 in a direction indicated by an arrow R1 illustrated in FIG. 5A in accordance with rotation of the pressing roller 31 in a direction indicated by an arrow R2. For this configuration, at a portion upstream the nip formation member 4, the fixing belt 21 is easy to contact close to the heat conductor 2. By contrast, at a portion downstream the nip formation member 4, the fixing belt 21 may not contact close to the heat conductor 2 depending on, for example, the hardness of the fixing belt 21 and/or the nipping direction of the nip formation member 4. Consequently, the degree of contact of the fixing belt 21 with the heat conductor 2 may be unstable, in particular, at the downstream side of the nip formation member 4 in the rotation direction R1 of the fixing belt 21. As described above, the degree and area of contact between the fixing belt 21 and the heat conductor 2 are factors that affect the surface temperature of the fixing belt 21.

According to the present exemplary embodiment, the heat conductor 2 includes the heater 3, such as a halogen heater, that heat the inner surface of the heat conductor 2 by the radiation heat thereof to conduct the heat to the fixing belt 21. The heat conductor 2 also includes a temperature detector to detect the surface temperature of the fixing belt 21 and adjusts the heating temperature thereof in accordance with a temperature detected by the temperature detector. The inner surface of the heat conductor 2 is coated black to increase the heat absorption efficiency. In this regard, the heater 3 may be, for example, an induction heater.

As described above, the relation between the inner diameter of the fixing belt 21 and the outer diameter of the heat conductor 2 affects the temperature of the fixing belt 21. Hence, in the present exemplary embodiment, the heat conductor 2 is formed to have a plurality of cross sections with different outer diameters in an axial direction, i.e., long direction of the heat conductor 2. In other words, the difference between the inner diameter of the fixing belt 21 and the outer diameter of the heat conductor 2 varies at certain positions, thus allowing adjustment of the heating distribution of the heat conductor 2. For example, as illustrated in FIG. 5C, the difference between the inner diameter of the fixing belt 21 and the outer diameter of the heat conductor 2 may be relatively great at end portions of the heat conductor 2 and relatively small at a middle portion of the heat conductor 2. By contrast, as illustrated in FIG. 5D, the difference between the inner diameter of the fixing belt 21 and the outer diameter of the heat conductor 2 may be relatively small at end portions of the heat conductor 2 and relatively great at a middle portion of the heat conductor 2 to suppress an increase in temperature of a middle portion of the fixing belt 21. In such configurations, a desired temperature distribution can be obtained by the shape of the heat conductor 2.

Figure 5B:
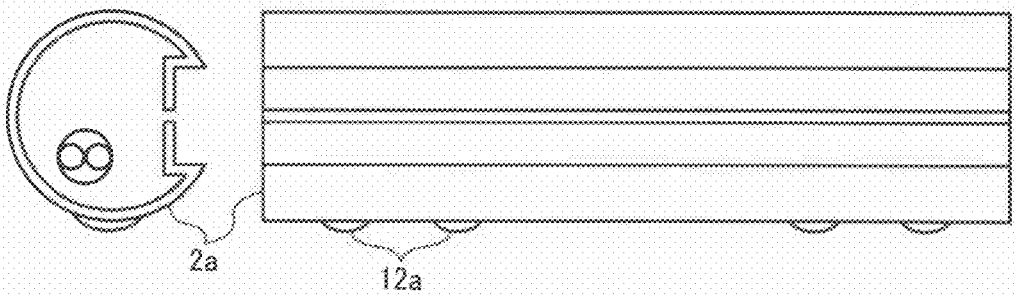
FIGS. 5B, 5C, and 5D are schematic views of different shapes of a heat conductor used in the fixing device.
Figure 5C:
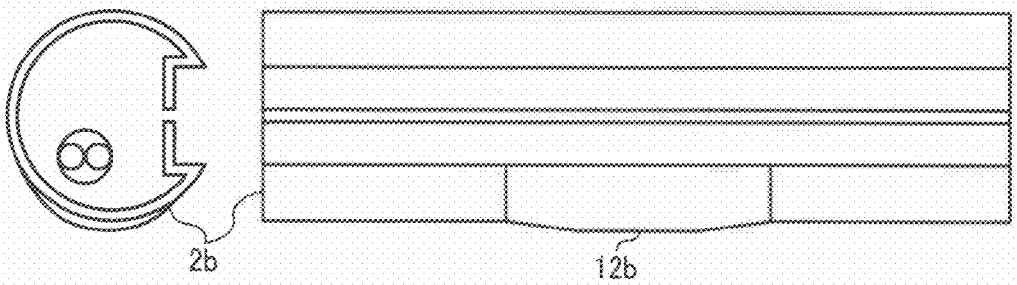
Figure 5D:
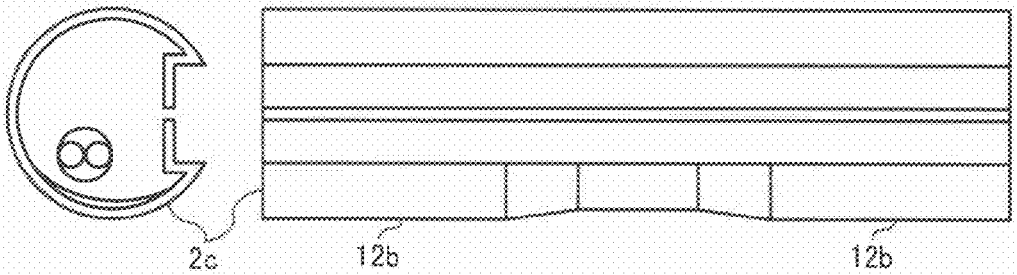

Alternatively, as illustrated in FIG. 5B, a plurality of ribs 12*a* may be formed at substantially the same intervals to conduct heat to the fixing belt 21 entirely in the axial direction of the fixing belt 21. Such a configuration can effectively increase the temperature of the fixing belt 21 while preventing an increase in the friction resistance.

Figure 6:
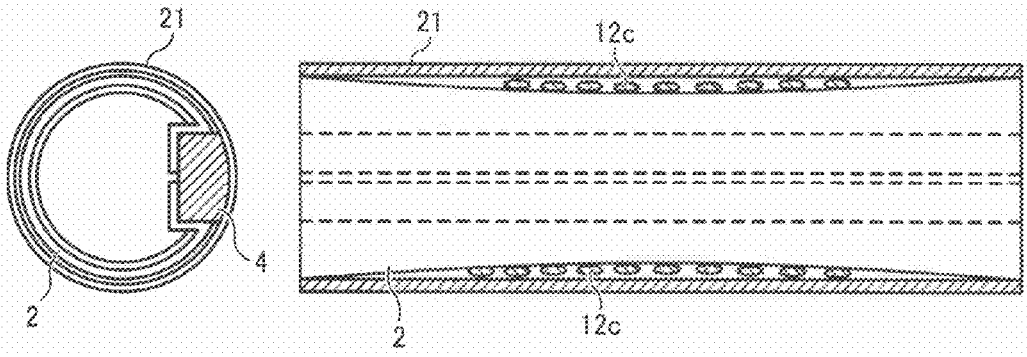
FIG. 6 is a schematic view of another shape of the heat conductor.

FIG. 6 is a schematic view of a shape of a heat conductor 2 according to another exemplary embodiment. Like FIGS. 5B to 5D, the difference between the outer diameter of the heat conductor 2 and the inner diameter of the fixing belt 21 varies so that the outer-diameter of the heat conductor 2 gradually increases from a middle portion of the heat conductor 2 toward end portions of the heat conductor 2.

Such a configuration can prevent grease 12C from leaking from ends of the clearance between the fixing belt 21 and the heat conductor 2 to the outside. The heat conductor 2 also has a hand-drum shape, thus allowing stable running of the fixing belt 21.

As described above, the fixing belt 21 rotates in accordance with the rotation of the pressing roller 31, and the hand-drum shape of the heat conductor 2 prevents the fixing belt 21 from sliding to one lateral side of the heat conductor 2 during conveyance of a recording sheet. Other configuration and operation are similar to, if not the same as, those of the fixing device 20 illustrated in FIGS. 5A to 5D, and therefore redundant descriptions thereof are omitted for simplicity.

Figure 7A:
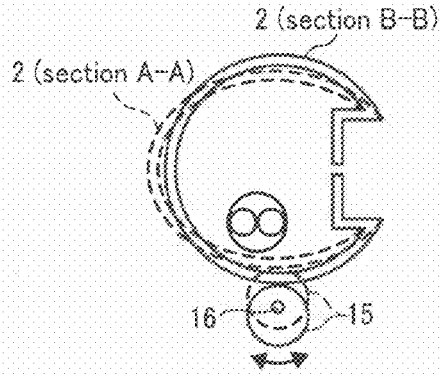
FIG. 7A is a schematic cross-sectional view of still another shape of the heat conductor.
Figure 7B:
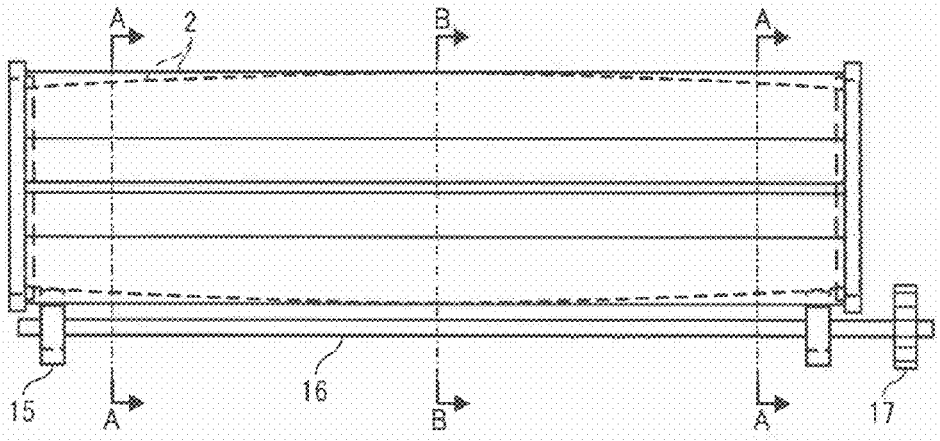
FIG. 7B is an elevation view of the heat conductor illustrated in FIG. 7A.

FIGS. 7A and 7B are schematic configuration views of a heat conductor 2 of a fixing device 20 according to an exemplary embodiment. As illustrated in FIGS. 7A and 7B, the fixing device 20 includes the heat conductor 2 and urging members 15, such as cams, to press and deform the heat conductor 2 from the outside of the heat conductor 2.

The urging members 15 that urge the heat conductor 2 are disposed at end portions of the heat conductor 2 outside a sheet pass area of the fixing belt 21. The urging members 15 may be rotatable or swingable to adjust the position thereof in accordance with information on the size of a recording sheet conveyed. The end portions of the heat conductor 2 are deformed by an external force of the cams 15 that is transmitted from a shaft 16 by rotation of a driving gear 17.

At this time, as described in FIG. 7A, the end portions of the heat conductor 2 are horizontally flattened to reduce the contact area at which the heat conductor 2 contacts the fixing belt 21. Meanwhile, as illustrated in FIG. 7B, a middle portion of the heat conductor 2 has a relatively high hardness and therefore is not so much affected by the pressure of the end portions. Accordingly, the cylindrical shape of the middle portion of the heat conductor 2 is not so much deformed, resulting in less influence to heat conductivity.

For example, when recording sheets of a small size are serially transported, heat transfer from the fixing belt 21 to the recording sheet may cause a thermal gradient in the axial direction of the fixing belt 21. Hence, for the above-described configuration, the end portions of the heat conductor 2 are deformed by pressure of the urging members 15 to reduce the heat transfer of the end portions of the heat conductor 2. Such a configuration can suppress an increase in the surface temperature of the end portions of the fixing belt 21, thus preventing a decrease in productivity when small-size recording sheets are transported.

Alternatively, the urging members 15 may be separately controlled so that the heat conductor 2 can be feedback-controlled in accordance with information on the temperature detected by a temperature detector. In FIGS. 7A and 7B, the urging members 15 are disposed at lower portions of the heat conductor 2. Alternatively, the urging members 15 may be disposed at upper portions of the heat conductor 2 or both the upper and lower portions.

Figure 8:
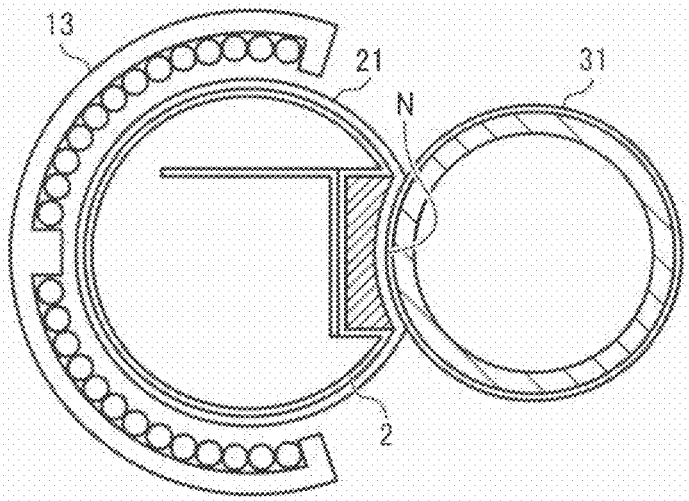
FIG. 8 is a schematic view of a fixing device configuration according to an exemplary embodiment of the present disclosure.

FIG. 8 is a schematic configuration view of a fixing device 20 according to an exemplary embodiment. The fixing device 20 according to this exemplary embodiment employs an electromagnetic induction heater 13, such as an induction heating (IF) coil, as a heat source. In a configuration in which the heat conductor 2 is heated by the electromagnetic induction heater 13, heat distribution is similar to the above-described exemplary embodiment. However, in a configuration in which the fixing belt 21 is heated by the electromagnetic induction heater 13, in contrast with the above-described configuration, more of the heat of the fixing belt 21 is removed by the contact with the heat conductor 2, resulting in a decreased temperature of the fixing belt 21. Accordingly, in contrast with the fixing device 20 illustrated in FIGS. 5A to 5D, the fixing belt 21 of FIG. 8 is disposed isolated from the heat conductor 2, thus achieving effects equivalent to those of the fixing device 20 illustrated in FIGS. 5A to 5D.

For such a configuration, by changing the contact area between the heat conductor 2 and the fixing belt 21, i.e., adjusting the shape of the heat conductor 2, the fixing device 20 can adjust the heating distribution of the fixing belt 21 without changing the heating distribution of the heater. In addition, the fixing device 20 can support the fixing belt 21 at certain points in a relatively limited range and thus prevent an increase in the torque required for driving the fixing belt 21.

Next, another comparative example of a fixing device 20C2 is described.

Figure 9:
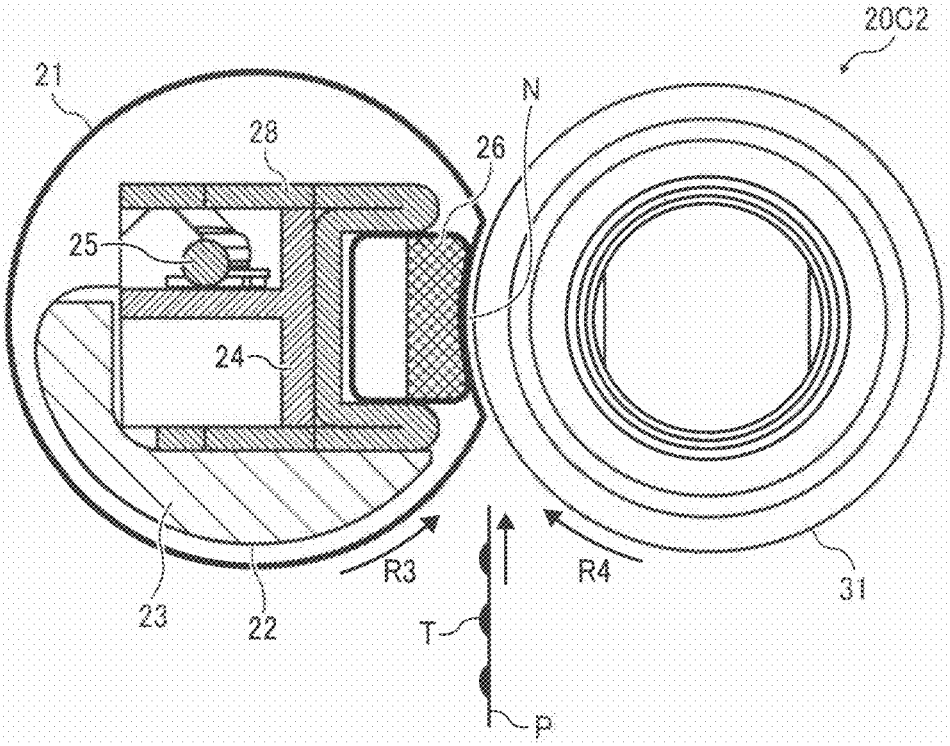
FIG. 9 is a cross-sectional view of a fixing device according to a comparative example.

FIG. 9 is a cross-sectional view of a fixing device 20C2 according to the comparative example. As illustrated in FIG. 9, the fixing device 20C2 includes a fixing sleeve 21 (also referred to as a fixing rotor) serving as a fixing member, a pressing roller 31 (also referred to as a pressing rotor) serving as a pressing member, a contact member 26 that contacts the pressing roller 31 with the fixing sleeve 21 interposed therebetween to form a nip between the fixing sleeve 21 and the pressing roller 31, a planar heat generator 22 that is disposed in contact with or adjacent to the fixing sleeve 21 at an inner circumferential side of the fixing sleeve 21 to heat the fixing sleeve 21 directly or indirectly, and a heat-generator support member 23 that is disposed at the inner circumferential side of the fixing sleeve 21 so as to sandwich the planar heat generator 22 between the fixing sleeve 21 and the heat-generator support member 23 to support the planar heat generator 22 at a certain position. In FIG. 9, the planar heat generator 22 contacts an inner circumferential surface of the fixing sleeve 21 to heat the fixing sleeve 21 directly.

Figure 10A:
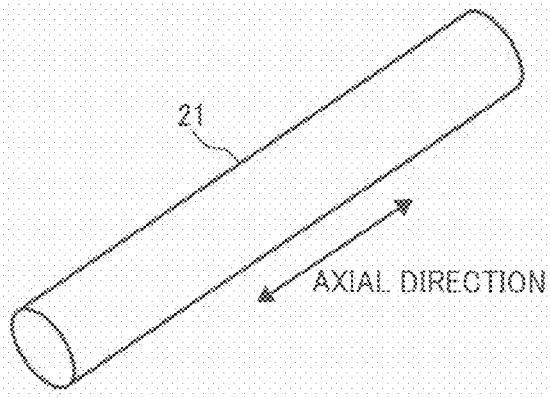
FIG. 10A is a schematic perspective view in an axial direction of a fixing sleeve.
Figure 10B:
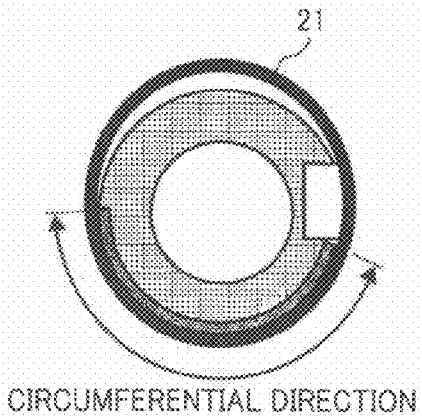
FIG. 10B is a schematic view depicting a circumferential direction of a fixing sleeve.

The fixing sleeve 21 has an axial length compatible with a width of a recording medium P to be conveyed through the nip between the fixing sleeve 21 and the pressing roller 31. The fixing sleeve 21 is a flexible, endless belt formed in a pipe (cylindrical) shape, and includes a metal substrate having a thickness of, for example, 30 to 50 μm and a release layer on the substrate. The outer diameter of the fixing sleeve 21 is, for example, 30 mm. Hereinafter, as illustrated in FIG. 10A, the long direction of the pipe shape of the fixing sleeve 21 is referred to as "axial direction", and as illustrated in FIG. 10B, the circumferential direction of the pipe shape of the fixing sleeve 21 is referred to as "circumferential direction".

The substrate of the fixing sleeve 21 includes a metal material of high thermal conductivity, such as iron, cobalt, nickel, or an alloy of at least two of the foregoing materials.

The surface release layer of the fixing sleeve 21 is formed by coating a fluorine compound, such as PFA, in a tubular shape on the substrate at approximately 50 μm thickness. The surface release layer facilitates toner particles of a toner image T to release from the surface of the fixing sleeve 21.

The pressing roller 31 may, for example, include a core metal, an elastic layer provided on the core metal, and a surface release layer provided on the elastic layer. The core metal includes a metal material, such as aluminum or copper. The elastic layer includes, for example, silicon (solid) rubber or other heat-resistant material. The outer diameter of the pressing roller 31 is, for example, 30 mm. The elastic layer is formed at approximately 2 mm thickness. The surface release layer of the pressing roller 31 is a fluorine compound, such as PFA, formed in a tubular shape at approximately 50 μm. A heater, such as a halogen heater, may be provided inside the metal core. The pressing roller 31 is pressed by an urging member, not illustrated, against the contact member 26 with the fixing sleeve 21 interposed therebetween. That is, a portion of the pressing roller 31 is pressed against a concave portion of the fixing sleeve 21 to form a nip through which a recording medium P is conveyed.

The pressing roller 31 is rotated in a direction indicated by an arrow R3 in FIG. 9 by a driving unit while being pressed against the fixing sleeve 21, and the fixing sleeve 21 rotates in a direction indicated by an arrow R4 in FIG. 9 in accordance with the rotation of the pressing roller 31.

The contact member 26 is relatively long in the axial direction of the fixing sleeve 21. At least a contact portion of the contact member 26 that is pressed by the pressing roller 31 with the fixing sleeve 21 interposed therebetween is formed of a heat-resistant flexible material, such as fluororubber. The contact member 26 is fixed by a core holder 28 at a certain position of the inner circumferential side of the fixing sleeve 21. The contact portion of the contact member 26 contacting an inner circumferential surface of the fixing sleeve 21 is preferably formed of a material of high slidability and wearing resistance, such as a Teflon (registered trademark) sheet.

The core holder 28 is a rigid plate, such as, a metal plate, formed by sheet processing, and has a length compatible with the axial length of the fixing sleeve 21 and a H-shaped cross section. The core holder 28 is disposed at a substantially central portion of the inner circumferential side of the fixing sleeve 21.

The core holder 28 holds components at certain positions in the inner circumferential side of the fixing sleeve 21. For example, the contact member 26 is accommodated in a recessed portion of the H shape of the core holder 28 at a side facing the pressing roller 31. The recessed portion of the core holder 28 supports the contact member 26 from a side opposite the nip so that the contact member 26 is not significantly deformed by the pressure of the pressing roller 31. The core holder 28 holds the contact member 26 in a manner so that the contact member 26 slightly protrudes from the core holder 28 toward the pressing roller 31. The core holder 28 is also disposed at a position such that the core holder 28 does not contact the fixing sleeve 21.

In addition, a terminal stay 24 and a power supply wiring 25 are accommodated in a recessed portion of the H shape of the core holder 28 at the other side (i.e., a side opposite the side facing the pressing roller 31). The terminal stay 24 has a length compatible with the axial length of the fixing sleeve 21 and a T-shaped cross section. The power supply wiring 25 extends on the terminal stay 24 to supply electric power from an external power source. Further, the outer surface of the H shape of the core holder 28 holds the heat-generator support member 23. In FIG. 9, the core holder 28 holds the heat-generator support member 23 at a substantially lower half area (i.e., a substantially semicircle area upstream the nip) of the fixing sleeve 21. Taking convenience of assembling into account, the heat-generator support member 23 may be adhered to the heat-generator support member 23. Alternatively, the heat-generator support member 23 may not be adhered to the core holder 28 to suppress heat transfer from the heat-generator support member 23 to the core holder 28.

The heat-generator support member 23 supports the planar heat generator 22 so as to press the planar heat generator 22 against the inner circumferential surface of the fixing sleeve 21. Accordingly, the heat-generator support member 23 has an outer circumferential surface of a certain arc length along the inner circumferential surface of the fixing sleeve 21 having a circular cross section.

The heat-generator support member 23 preferably has a heat resistance enough to withstand the heat from the planar heat generator 22, a strength enough to support the planar heat generator 22 without deformation when the fixing sleeve 21 while rotating contacts the planar heat generator 22, and a heat insulation performance enough to transfer the heat from the planar heat generator 22 to the fixing sleeve 21 while preventing the heat of the planar heat generator 22 from being transferred to the fixing sleeve 21. For example, the heat-generator support member 23 is preferably a molded foam of polyimide resin. In addition, a solid resin member may be supplementarily provided within the polyimide resin foam to reinforce the hardness of the heat-generator support member 23.

Figure 11:
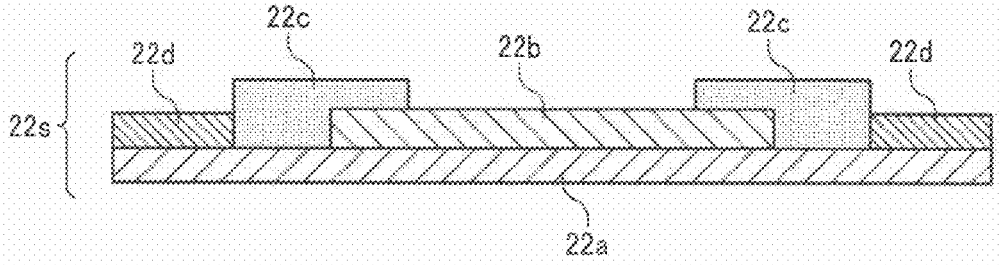
FIG. 11 is a cross-sectional view of a configuration of a heat generation sheet.

As illustrated in FIG. 11, the planar heat generator 22 includes a flexible heat generation sheet 22*s* having a certain width and length compatible with the axial width and circumferential length of the fixing sleeve 21. The heat generation sheet 22*s* includes an insulative base layer 22*a*, a resistant heat generation layer 22*b* in which electroconductive particles are dispersed in heat-resistant resin, and electrode layers 22*c* that supply power to the resistant heat generation layer 22*b*. In the heat generation sheet 22*s*, the resistant heat generation layer 22*b* and the electrode layers 22*c* are formed on the base layer 22*a*. In addition, insulation layers 22*d* are provided on the base layer 22*a* to electrically insulate the resistant heat generation layer 22*b* from adjacent electrode layers 22*c* of another power supply and edge portions of the heat generation sheet 22*s* from the outside. The planar heat generator 22 includes electrode terminals 22*e* that are connected to the electrode layers 22*c* at the end portions of the heat generation sheet 22*s* to supply power, which is supplied from the power supply wiring 25, to the electrode layers 22*c*.

The heat generation sheet 22*s* has a thickness in a range of from approximately 0.1 mm to approximately 1.0 mm, and has a flexibility sufficient to wrap around the heat generator support 23 depicted in FIG. 11 at least along an outer circumferential surface of the heat generator support 23.

The base layer 22*a* is a thin, elastic film including a certain heat-resistant resin such as polyethylene terephthalate (PET) or polyimide resin. For example, the base layer 22*a* may be a film including polyimide resin to provide heat resistance, insulation, and a certain level of flexibility.

The resistant heat generation layer 22*b* is a thin, conductive film in which conductive particles, such as carbon particles and metal particles, are uniformly dispersed in a heat-resistant resin such as polyimide resin. When power is supplied to the resistant heat generation layer 22*b*, internal resistance of the resistant heat generation layer 22*b* generates Joule heat. The resistant heat generation layer 22*b* is manufactured by coating the base layer 22*a* with a coating compound in which conductive particles, such as carbon particles and metal particles, are dispersed in a precursor including a heat-resistant resin such as polyimide resin.

Alternatively, the resistant heat generation layer 22*b* may be manufactured by providing a thin conductive layer including carbon particles and/or metal particles on the base layer 22*a* and then providing a thin insulation film including a heat-resistant resin such as polyimide resin on the thin conductive layer. Thus, the thin insulation film is laminated on the thin conductive layer to integrate the thin insulation film with the thin conductive layer.

The carbon particles used in the resistant heat generation layer 22*b* may be known carbon black powder or carbon nanoparticles formed of at least one of carbon nanofiber, carbon nanotube, and carbon microcoil.

The metal particles used in the resistant heat generation layer 22*b* may be silver, aluminum, and/or nickel particles, and may be granular or filament-shaped.

The insulation layer 22*d* may be manufactured by coating the base layer 22*a* with an insulation material including a heat-resistant resin identical to the heat-resistant resin of the base layer 22*a*, such as polyimide resin.

The electrode layer 22*c* may be manufactured by coating the base layer 22*a* with a conductive ink or a conductive paste such as silver. Alternatively, metal foil or a metal mesh may be adhered to the base layer 22*a*.

The heat generation sheet 22*s* of the planar heat generator 22 is a thin sheet having a small heat capacity, and is heated quickly. An amount of heat generated by the heat generation sheet 22*s* is arbitrarily set according to volume resistivity of the resistant heat generation layer 22*b*. In other words, the amount of heat generated by the heat generation sheet 22*s* can be adjusted according to material, shape, size, and dispersion of conductive particles of the resistant heat generation layer 22*b*. For example, the planar heat generator 22 providing heat generation per unit area of 35 W/cm$^2$ outputs total power of approximately 1,200 W with the heat generation sheet 22*s* having the width of approximately 20 cm in the axial direction of the fixing sleeve 21 and the length of approximately 2 cm in the circumferential direction of the fixing sleeve 21, for example.

If a metal filament, such as a stainless steel filament, is used as a planar heat generator, the metal filament causes asperities on a surface of the planar heat generator. Accordingly, when the inner circumferential surface of the fixing sleeve 21 slides over the planar heat generator, the asperities of the planar heat generator wear the surface of the planar heat generator easily. To address this problem, according to this exemplary embodiment, the heat generation sheet 22*s* has a smooth surface without asperities as described above, providing improved durability against sliding of the inner circumferential surface of the fixing sleeve 21 over the planar heat generator 22. Further, a surface of the resistant heat generation layer 22*b* of the heat generation sheet 22*s* may be coated with fluorocarbon resin to further improve durability against sliding of the inner circumferential surface of the fixing sleeve 21 over the planar heat generator 22.

In FIG. 9, the heat generation sheet 22*s* faces the inner circumferential surface of the fixing sleeve 21 in a region in the circumferential direction of the fixing sleeve 21 between a position on the fixing sleeve 21 opposite the nip N and a position upstream from the nip N in the rotation direction R3 of the fixing sleeve 21. However, the arrangement of the heat generation sheet 22*s* is not limited to that described in FIG. 9 and may be any other suitable arrangement.

With the above-described configuration, the fixing device 20C2 can shorten a warm-up time and a first print time of the fixing device 20C2 while saving energy. Further, the heat generation sheet 22*s* is a resin sheet. Accordingly, even when rotation and vibration of the pressing roller 31 applies stress to the heat generation sheet 22*s* repeatedly, and bends the heat generation sheet 22*s* repeatedly, the heat generation sheet 22*s* is not broken due to wear and the fixing device 20 operates for longer time.

However, for the fixing device 20C2, the fixing sleeve 21 may be subject to non-uniform temperature distribution in the axial direction thereof, which might result in unstable fixing. Through intensive investigations of the cause of the non-uniform temperature distribution, the present inventors have found that the fixing sleeve 21 may not contact the planar heat generator 22 (the heating sheet 22*s*) in the axial direction of the fixing sleeve 21 in a uniform manner, resulting in non-uniform efficiency of heat transfer and non-uniform temperature distribution. To cope with such challenges, a fixing device according to exemplary embodiments of the present disclosure has a configuration described below.

Below, a fixing device 20 according to an exemplary embodiment of the present disclosure is described.

Figure 12:
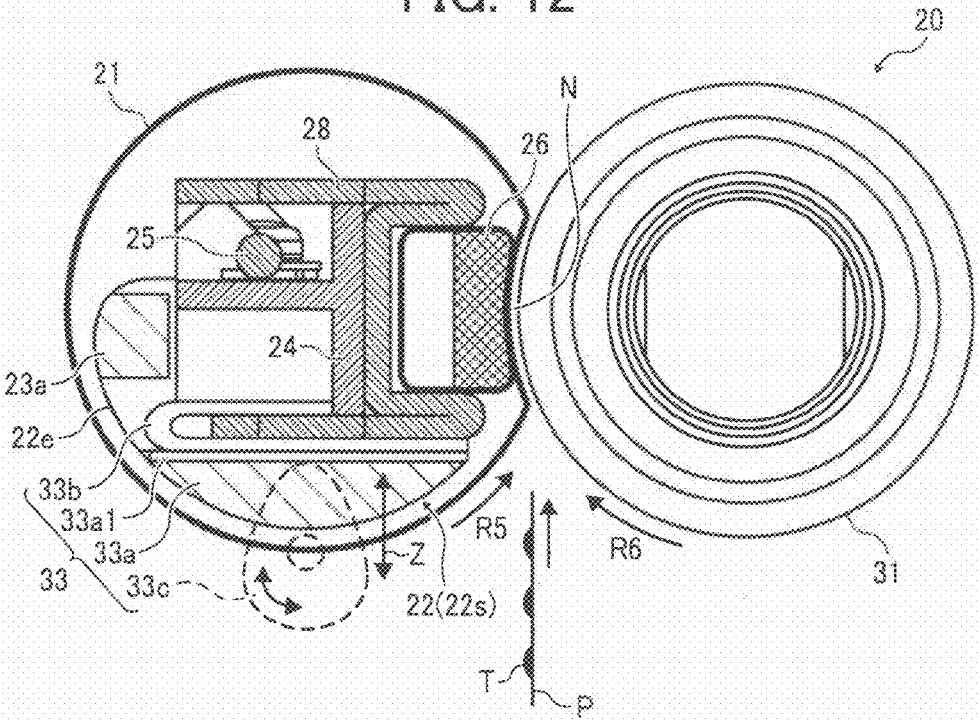
FIG. 12 is a cross-sectional view of a fixing device according to an exemplary embodiment of the present disclosure.

FIG. 12 is a cross-sectional view of a configuration of the fixing device 20 according to the present exemplary embodiment. Specifically, FIG. 12 illustrates a configuration of a cross-section of an end portion of the fixing device 20 in an axial direction of a fixing sleeve 21.

The fixing device 20 includes a fixing sleeve 21, a pressing roller 31, a contact member 26, a flexible planar heat generator 22, and a heat-generator moving unit 33. The fixing sleeve 21 is a rotary endless belt serving as a fixing member. The pressing roller 31 contacts an outer circumferential surface of the fixing sleeve 21 and serves as a pressing member. The contact member 26 is disposed at an inner circumferential side of the fixing sleeve 21 and pressed by the pressing roller 31 with the fixing sleeve 21 interposed therebetween to form a nip between the fixing sleeve 21 and the pressing roller 31. The planar heat generator 22 is disposed so as to be contactable with the fixing sleeve 21 at the inner circumferential side of the fixing sleeve 21 to heat the fixing sleeve 21. The heat-generator moving unit 33 includes a heat-generator support member 33*a* that is disposed at the inner circumferential side of the fixing sleeve 21 so as to sandwich the planar heat generator 22 between the fixing sleeve 21 and the heat-generator support member 23 to support the planar heat generator 22 at a certain position. The heat-generator moving unit 33 moves the heat-generator support member 33*a* in a direction, which is indicated by an arrow Z in FIG. 12, to push or separate the heat-generator support member 33*a* against or from the inner circumferential surface of the fixing sleeve 21 to press or separate the planar heat generator 22 against or from the fixing sleeve 21.

In FIG. 12, the fixing sleeve 21, a terminal stay 24, power supply wiring 25, the contact member 26, a core holder 28, and the pressing roller 31 have configurations similar to the fixing device 20C2 illustrated in FIG. 9. The fixing device 20 includes the heat-generator support member 33*a* instead of the heater support member 23 illustrated in FIG. 9. Further, the fixing device 20 may include an insulation support member 29 illustrated in FIG. 17.

The planar heat generator 22 is, for example, a single sheet including the heat generation sheet 22*s* and an electrode terminal 22*e*. In FIG. 12, for the planar heat generator 22, the heating sheet 22*s* is supported by the heat-generator support member 33*a* so as to be contactable with the inner circumferential surface of the fixing sleeve 21, and the electrode terminal 22*e* extending from the heat generation sheet 22*s* is supported by an insulation member 23*a* isolated from the fixing sleeve 21 to be connected to the power supply line 25.

The heat generation sheet 22*s* has a basic configuration similar to the configuration of the heat generation sheet 22*s* of FIG. 11 and is a sheet member having a width compatible with an axial width of a maximum sheet-pass area of the fixing sleeve 21 and a certain length compatible with a circumferential length of the fixing sleeve 21. A resistant heat generation layer 22*b* is provided entirely or partially on a surface of the base layer 22*a*. When power is supplied from the electrode terminal 22*e* to the resistant heat generation layer 22*b*, heat is generated from the entire surface of the heat generation sheet 22*s* in a uniform manner.

The heat generation sheet 22*s* has a thickness in a range of from approximately 0.1 mm to approximately 1.0 mm, and has a flexibility sufficient to wrap around the heat generator support 33*a* along an outer circumferential surface of the heat generator support 33*a*.

The heat-generator moving unit 33 includes the heat-generator support member 33*a* that supports the heat generation sheet 22*s*, protrusions 33*a*1 provided with the heat-generator support member 33*a*, leaf springs 33*b* that urge the protrusions 33*a*1, driving cams 33*c* that support the protrusions 33*a*1, and a driving system that drives the driving cams 33*c*.

As illustrated in FIG. 13, the protrusions 33*a*1, the leaf springs 33*b*, and the driving cams 33*c* are provided at axial end portions of the heat-generator support member 33*a*.

The heat-generator support member 33*a* supports the heat generation sheet 22*s* of the planar heat generator 22 so that the heat generation sheet 22*s* is in contact with the inner circumferential surface of the fixing sleeve 21.

The heat-generator support member 33*a* preferably has a heat resistance sufficient to withstand the heat from the planar heat generator 22, a strength sufficient to support the heat generation sheet 22*s* without deformation when the fixing sleeve 21 while rotating contacts the heat generation sheet 22*s*, and a heat insurance sufficient to conduct the heat from the heat generation sheet 22*s* to the fixing sleeve 21 while preventing the heat of the planar heat generator 22 from migrating to the fixing sleeve 21. For example, the heat-generator support member 33*a* is preferably a molded body including heat-resistant resin, such as polyimide resin, heat-resistant polyethylene terephthalate (PET) resin, and/or liquid crystal polymer (LCP), or a molded foam of polyimide resin. In addition, a solid resin member may be supplementarily provided within the polyimide resin foam to reinforce the hardness of the heat-generator support member 23.

The heat-generator support member 33*a* has an outer circumferential surface of a certain arc length along the inner circumferential surface of the fixing sleeve 21 that has a circular, circumferential cross-section (see FIG. 12), an axial linear shape (see FIG. 13), and a semicircular cross-section in a direction perpendicular to the axial direction of the heat-generator support member 33*a*.

The protrusions 33*a*1 are plate members integrally formed with the heat-generator support member 33*a* so as to protrude from both axial ends of the heat-generator support member 33*a*. The protrusions 33*a*1 may be provided on both axial end faces of the heat-generator support member 33*a*. Alternatively, as illustrated in FIG. 13, a single plate member may be provided on a first face of the heat-generator support member 33*a* opposite a second face facing the fixing sleeve 21 so as to protrude from both axial end portions of the heat-generator support member 33*a*. In this configuration, portions of the single plate member protruding from both axial end portions of the heat-generator support member 33*a* serve as the protrusions 33*a*1.

The leaf springs 33*b* are elastic members fixed on the core-support member 28 to press against the first face (e.g., an upper face in FIGS. 12 and 13) of the heat-generator support member 33*a* opposite the second face facing the fixing sleeve 21. That is, the leaf springs 33*b* press the protrusions 33*a*1 toward the fixing sleeve 21 (for example, downward in FIGS. 12 and 13) by the elastic force thereof while using the core-support member 28 as a base.

Each of the driving cams 33*c* is an oval-shaped disc cam that supports the corresponding protrusion 33*a*1 in contact with a face (for example, a lower face in FIGS. 12 and 13) of the protrusion 33*a*1 opposite a face of the protrusion 33*a*1 pressed by the leaf springs 33*b*. In accordance with the rotation angle, the driving cams 33*c* change the height at which the driving cams 33*c* support the protrusions 33*a*1 (i.e., the position of the protrusions 33*a*1 relative to the rotation-axis center in a cross-section of the fixing sleeve 21). For example, in FIG. 12, the protrusions 33*a*1 are located by the driving cams 33*c* at a position (height A) farthest from the fixing sleeve 21.

The heat-generator support member 33*a* and the heat generation sheet 22*s* of the heat-generator moving unit 33 are moved as follows.

[Contact Operation 1-1]

The driving cams 33*c* are rotated by a driving force of an external device (driving system) through a certain rotation angle in a clockwise direction from the state shown in FIG. 12 so that the driving cams 33*c* support the protrusions 33*a*1 at a position (height position B) close to the fixing sleeve 21. At this time, since the leaf springs 33*b* push the protrusions 33*a* toward the fixing sleeve 21, the protrusions 33*a*1 move toward the fixing sleeve 21 and simultaneously, the heat-generator support member 33*a* moves toward the fixing sleeve 21. As a result, the heat generation sheet 22*s* supported by the outer circumferential surface of the heat-generator support member 33*a* contacts the inner circumferential surface of the fixing sleeve 21. In this state, the heat generation sheet 22*s* is in contact with the fixing sleeve 21 substantially without pressure. Consequently, although a certain amount of heat is transferred from the heat generation sheet 22*s* to the fixing sleeve 21, the heat transfer may be non-uniform in the axial direction of the fixing sleeve 21.

[Contact Operation 1-2]

Then, the driving cams 33*c* are further rotated so that the driving cams 33*c* support the protrusions 33*a*1 at a position (height position C) closer to the fixing sleeve 21. By a pressing force of the leaf springs 33*b*, the heat-generator support member 33*a* is moved to press against the inner circumferential surface of the fixing sleeve 21. As a result, the heat generation sheet 22*s* contacts the inner circumferential surface of the fixing sleeve 21 at a certain pressure (see FIG. 13). In other words, the heat generation sheet 22*s* slidably contacts the inner circumferential surface of the fixing sleeve 21. Such a configuration allows the heat generation sheet 22*s* to press against the fixing sleeve 21 at a pressure greater than a threshold value over the entire width of the heat generation sheet 22*s* in the axial direction of the fixing sleeve 21. As a result, the efficiency of heat transfer from the heat generation sheet 22*s* to the fixing sleeve 21 becomes substantially uniform over the entire area in the axial direction of the fixing sleeve 21, allowing the fixing sleeve 21 to be heated in a uniform manner in the axial direction of the fixing sleeve 21. Thus, excellent fixing performance and uniform image gloss can be obtained in the axial direction of the fixing sleeve 21.

[Separating Operation]

When the protrusions 33*a*1 are supported at the height position C, the driving cams 33*c* are rotated by an external driving force through a certain rotation angle in the counter-clockwise direction in FIG. 12. Thus, the driving cams 33*c* push up the protrusions 33*a*1 against the pressing force of the leaf springs 33*b* to support the protrusions 33*a*1 at a position (height position A) away from the fixing sleeve 21. Simultaneously, the heat-generator support member 33*a* moves away from the inner circumferential surface of the fixing sleeve 21, and as a result, the heat generation sheet 22*s* separates from the inner circumferential surface of the fixing sleeve 21 (see FIG. 12).

For the fixing device 20, during preliminary operation of the fixing operation, the heat generation sheet 22*s* is separated from the inner circumferential surface of the fixing sleeve 21 by this separating operation. Such a configuration can prevent residual heat of the heat generation sheet 22*s* from being transferred to the fixing sleeve 21 and separate the heat capacity of the heat generation sheet 22*s* from the heat capacity of the fixing sleeve 21, thus shortening the time to cool down and reload. In this time, the heat generation sheet 22*s* is supplied with power to generate heat. Therefore, to prevent excess temperature rise in the heat generation sheet 22*s*, preferably a temperature detector is provided to detect the temperature of the heat generation sheet 22*s* at multiple points along the axial direction of the fixing sleeve 21.

Referring to FIGS. 12 and 13, the following describes operation of the fixing device 20 having the above-described structure.

When the image forming apparatus 1 receives an output signal, for example, when the image forming apparatus 1 receives a print request specified by a user by using a control panel or a print request sent from an external device, such as a personal computer, the pressing roller 31 is pressed against the contact member 26 with the fixing sleeve 21 interposed therebetween to form the nip N between the pressing roller 31 and the fixing sleeve 21.

Thereafter, a driving unit drives and rotates the pressing roller 31 clockwise in FIG. 12 in the rotation direction R6. Accordingly, the fixing sleeve 21 rotates counterclockwise in FIG. 12 in the rotation direction R5 in accordance with rotation of the pressing roller 31. A heat-generator moving unit 33 urges the heating sheet 22*s* of the planar heat generator 22 to contact the inner circumferential surface of the fixing sleeve 21 over an entire axial width of the fixing sleeve 21 at a force greater than a certain pressure, and the fixing sleeve 21 slides over the planar heat generator 22.

Simultaneously, an external power source or an internal capacitor supplies power to the planar heat generator 22 via the power supply wiring 25 to cause the heat generation sheet 22*s* to generate heat. The heat generated by the heat generation sheet 22*s* is transmitted effectively to the fixing sleeve 21 via the contact portion of the heat generation sheet 22*s* with the fixing sleeve 21, so that the fixing sleeve 21 is heated quickly. Alternatively, heating of the fixing sleeve 21 by the planar heat generator 22 may not start simultaneously with driving of the pressing roller 31 by the driver. In other words, the planar heat generator 22 may start heating the fixing sleeve 21 at a time different from a time at which the driver starts driving the pressing roller 31.

A temperature detector is provided at a position upstream from the nip N in the rotation direction R5 of the fixing sleeve 21. The temperature detector may be provided in contact with the fixing sleeve 21. Alternatively, the temperature detector may be spaced away from the fixing sleeve 21. The temperature detector detects a temperature of the fixing sleeve 21 or the heat generator support 23 to control heat generation of the planar heat generator 22 based on a detection result provided by the temperature detector so as to heat the nip N up to a predetermined fixing temperature. When the nip N is heated to the predetermined fixing temperature, the fixing temperature is maintained, and a recording medium P is conveyed to the nip N.

In the fixing device 20 according to this exemplary embodiment, the fixing sleeve 21 and the planar heat generator 22 have small heat capacities, shortening a warm-up time and a first print time of the fixing device 20 while saving energy. Further, the heat generation sheet 22*s* is a resin sheet. Accordingly, even when rotation and vibration of the pressing roller 31 stresses the heat generation sheet 22*s* repeatedly, and bends the heat generation sheet 22*s* repeatedly, the heat generation sheet 22*s* is not broken due to wear, and the fixing device 20 operates for longer time. In addition, the fixing sleeve 21 is heated in an uniform manner in the axial direction thereof, thus achieving excellent fixing performance in the axial direction and uniform image gloss.

When the image forming apparatus 1 does not receive an output signal, the pressing roller 31 and the fixing sleeve 21 do not rotate and power is not supplied to the planar heat generator 22 to reduce power consumption. However, in order to restart the fixing device 20 immediately after the image forming apparatus 1 receives an output signal, power can be supplied to the planar heat generator 22 while the pressing roller 31 and the fixing sleeve 21 do not rotate. For example, power in an amount sufficient to keep the entire fixing sleeve 21 warm is supplied to the planar heat generator 22.

In a "non-adhesion" case, in which the heat generation sheet 22*s* is not fixed to the heat-generator support member 33*a* with an adhesive, the electrode terminal 22*e* at a side of the heat generation sheet 22*s* opposite a side facing the nip N is fixed to the terminal stay 24 by, for example, a screw. When the fixing sleeve 21 rotates so as to pull the heat generation sheet 22*s* from the fixed side toward the nip N, the heat generation sheet 22*s* contacts the fixing sleeve 21 in a stable manner with the heat generation sheet 22*s* sandwiched by the heat-generator support member 33*a* and the inner circumferential surface of the fixing sleeve 21, thus allowing efficient heating of the fixing sleeve 21.

However, if the fixing sleeve 21 is rotated in reverse, for example, to remove a paper jam with the heat generation sheet 22*s* being isolated from the heat-generator support member 33*a*, the heat generation sheet 22*s* might be pulled up and displaced. Further, such displacement of the heat generation sheet 22*s* might cause the generation sheet 22*s* to be twisted or deformed. Hence, to prevent displacement of the heat generation sheet 22*s*, the heat generation sheet 22*s* is preferably fixed to the heat-generator support member 33*a* with an adhesive.

In this case, if the entire surface of the heat generation sheet 22*s* is adhered to the heat-generator support member 33*a*, heat of the heat generation sheet 22*s* is easily transferred from the entire surface of the heat generation sheet 22*s* to the heat-generator support member 33*a*, which is undesirable. Hence, in end portions of the heat generation sheet 22*s* corresponding to the axial end portions of the fixing sleeve 21, non-sheet-pass (surface) areas over which a recording medium P does not pass are preferably adhered to the heat-generator support member 33*a*.

Such a configuration prevents displacement of the heat generation sheet 22*s*. In addition, since a sheet pass area of the heat generation sheet 22*s* (for example, a maximum sheet-pass area over which a recording medium P of a maximum usable size passes) is not adhered to the heat-generator support member 33*a*, heat transfer from the sheet pass area of the heat generation sheet 22*s* to the heat-generator support member 33*a* can be suppressed. As a result, heat generated in the sheet pass area of the heat generation sheet 22*s* can be effectively used to heat the fixing sleeve 21.

The heat generation sheet 22*s* may be adhered to the heat-generator support member 33*a* by applying a liquid adhesive material. Alternatively, a tape-shaped adhesive member (for example, double-sided adhesive tape) of a heat-resistant acrylic material or silicone material having adhesive or viscous faces may be used to adhere the heat generation sheet 22*s* to the heat-generator support member 33*a*. Such a configuration facilitates the planar heat generator 22 (the heat generation sheet 22*s*) to be adhered to the heat-generator support member 33*a* and allows the planar heat generator 22 to be replaced with a new one by removing the double-sided adhesive tape, thus facilitating servicing.

In this regard, if the double-sided adhesive tape is simply sandwiched between the heat generation sheet 22*s* and the heat-generator support member 33*a*, a portion of the surface of the heat generation sheet 22*s* in the axial direction of the fixing sleeve 21 at which the heat generation sheet 22*s* is adhered to the heat-generator support member 33*a* by the double-sided adhesive tape is lifted by a thickness of the double-sided adhesive tape. Consequently, the planar heat generator 22 (the heat generation sheet 22*s*) may not contact the fixing sleeve 21 in a uniform manner over the sheet pass area of the planar heat generator 22, resulting in a reduced heating efficiency and a non-uniform temperature distribution in the axial direction of the fixing sleeve 21.

Hence, a portion of the heat generation sheet 22*s* at which the double-sided adhesive tape is adhered may have a thickness smaller than other portions of the planar heat generator 22 by the thickness of the double-sided adhesive tape. Accordingly, since the double-sided adhesive tape has a certain thickness of, for example, 0.1 mm, a recessed portion extending in the circumferential direction at a depth corresponding to the thickness of the double-sided adhesive tape is provided at, for example, axial end portions of a surface of the base layer 22*a* facing the heat-generator support member 33*a*. The double-sided adhesive tape is adhered to the recessed portion, and the heat generation sheet 22*s* is adhered to a certain point of the heat-generator support member 33*a* via the double-sided adhesive tape.

Thus, when the heat generation sheet 22*s* is adhered to the heat-generator support member 33*a*, the surface of the heat generation sheet 22*s* facing the fixing sleeve 21 is flattened in the axial direction of the fixing sleeve 21 and the planar heat generator 22 (the heat generation sheet 22*s*) contacts the fixing sleeve 21 in a uniform manner over the sheet pass area. Such a configuration can achieve a good heating efficiency and a uniform temperature distribution in the axial direction of the fixing sleeve 21.

Alternatively, the heat-generator support member 33*a* may have recessed portions at positions corresponding to the non-sheet pass areas of the heat generation sheet 22*s* at a depth corresponding to the thickness of the double-sided adhesive tape. In other words, the recessed portions extending in the circumferential direction of the fixing sleeve 21 and having a depth corresponding to the thickness of the double-sided adhesive tape are provided at the positions corresponding to the non-sheet-pass areas of the heat generation sheet 22*s* in the axial end portions of the heat-generator support member 33*a*. The double-sided adhesive tape is adhered to the recessed portions, and the heat generation sheet 22*s* is adhered to the heat-generator support member 33*a* via the double-sided adhesive tape. Thus, the surface of the heat generation sheet 22*s* facing the fixing sleeve 21 is flattened in the axial direction of the fixing sleeve 21, and the planar heat generator 22 (the heat generation sheet 22*s*) contacts the fixing sleeve 21 in a uniform manner over the sheet pass area. Such a configuration can achieve a good heating efficiency and a uniform temperature distribution in the axial direction of the fixing sleeve 21.

As described above, for the fixing device 20C2 illustrated in FIG. 9, in order to cope with different sizes of recording media conveyed, the resistant heat generation layer 22*b* is provided on each of a plurality of regions zoned on the surface of the base layer 22*a* in the axial direction of fixing sleeve 21 in such a manner that each resistant heat generation layer 22*b* generates heat independently.

FIG. 14A is a plan view of a planar heat generator 22 as one variation of the planar heat generator 22. As illustrated in FIG. 14A, the planar heat generator 22 includes a heat generation sheet 22*s*U. The heat generation sheet 22*s*U includes resistant heat generation layers 22*b*1 and 22*b*2. FIG. 14A is a plan view of the planar heat generator 22 spread on a flat surface before the planar heat generator 22 is adhered to the heat generator support 23. In FIG. 14A, the horizontal direction is a width direction of the planar heat generator 22 corresponding to the axial direction of the fixing sleeve 21 and the vertical direction is a circumferential direction of the planar heat generator 22 corresponding to the circumferential direction of the fixing sleeve 21.

In FIG. 14A, the main surface of the heat generation sheet 22*s* is divided into three areas in the width direction of the heat generation sheet 22*s* (i.e., the axial direction of the fixing sleeve 21) and further divided into two areas in the length direction of the heat generation sheet 22*s* (i.e., the circumferential direction of the fixing sleeve 21). That is, the heat generation sheet 22*s* is divided into six segments. Here, consider the six segments as a matrix having row elements corresponding to the areas in the length direction of the heat generation sheet 22*s* (i.e., the circumferential direction of the fixing sleeve 21) and column elements corresponding to the areas in the width direction of the heat generation sheet 22*s* (i.e., the axial direction of the fixing sleeve 21). As illustrated in FIG. 14B, a resistant heat generation layer 22*b*1 of a certain width and length is provided at the segment of the (1,2) element corresponding to an axial middle portion of the fixing sleeve 21. Further, resistant heat generation layers 22*b*2 of a certain width and length are provided at the segments of the (2,1) and (2,3) elements corresponding to axial end portions of the fixing sleeve 21.

Electrode layers 22*c* connected to the resistant heat generation layer 22*b*1 are provided at the segments of the (1,1) and (1,3) elements. Further, electrode terminals 22*e*1 extended from an end (for example, a lower end in FIG. 14A) of the heat generation sheet 22*s* are provided at the electrode layers 22*c* to form a first heat generation circuit.

Further, an electrode layer 22*c* connecting resistant heat generation layers 22*b*2 is provided at the segment of the (2,2) element. Further, two more electrode layers 22*c* are connected to the respective resistant heat generation layers 22*b*2 so as to extend in the length direction of the heat generation sheet 22*s* (i.e., the circumferential direction of the fixing sleeve 21) toward the end (the lower end in FIG. 14A) of the heat generation sheet 22*s*. Electrode terminals 22*e*2 are provided at the respective electrode layers 22*c* so as to extend from the end of the heat generation sheet 22*s*. Thus, a second heat generation circuit is formed.

Insulation layers 22*d* are provided between the first heat generation circuit and the second heat generation circuit to isolate the two layers from each other and prevent them from short-circuiting.

For the planar heat generator 22 illustrated in FIG. 14A, when power is supplied from the electrode terminals 22*e*1, the resistant heat generation layer 22*b*1 generates Joule heat because of internal resistance while the electrode layers 22*c* generate little heat because of low resistance. As a result, only the segment of the (1,2) element of the heat generation sheet 22*s* generates heat, thus heating only the axial middle portion of the fixing sleeve 21.

Further, when power is supplied from the electrode terminals 22*e*2, the resistant heat generation layers 22*b*2 generates Joule heat because of internal resistance while the electrode layers 22*c* generate little heat because of low resistance. As a result, only the segment of the (2,1) and (2,3) elements of the heat generation sheet 22*s* generate heat, thus heating the axial end portions of the fixing sleeve 21.

Thus, when a recording medium P of a small size (width) passes the fixing device 20, power is supplied only to the electrode terminals 22*e*1 to heat only the axial middle portion of the fixing sleeve 21. By contrast, when a recording medium P of a large size (width) passes the fixing device 20, power is supplied to the electrode terminals 22*e*1 and the electrode terminals 22*e*2 to heat the entire axial portion of the fixing sleeve 21. Such a configuration can perform proper fixing in accordance with the widths of recording media P while suppressing power consumption. In addition, the heat generation amount of the planar heat generator 22 can be adjusted in accordance with the width of recording media P. Therefore, such a configuration can prevent excessive temperature rise in the non-sheet-pass area even if small-size recording media pass the fixing device 20, thus preventing stopping of the fixing device for protecting the components and/or a reduction in productivity.

However, if the configuration of FIG. 14A is employed, the fixing device 20 is compatible with only two different sizes of recording media and has limitations in flexibly dealing with more different sizes of recording media.

By contrast, below, a description is given of a configuration of a fixing device 20 according to an exemplary embodiment of the present disclosure.

The fixing device 20 according to this exemplary embodiment has a basic configuration (in particular, cross-sectional configuration) similar to that illustrated in FIG. 12. Therefore, the following describes components differing from those of the fixing device 20 illustrated in FIG. 12 (for example, the axial shape of a heat-generator support member 33*a*) and operation of a heat-generator moving unit 33.

Figure 15A:
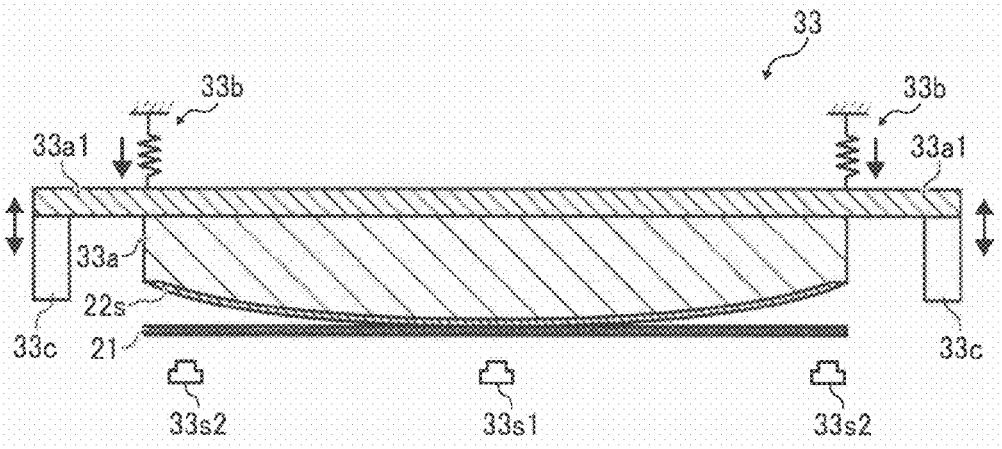
FIGS. 15A and 15B are schematic cross-sectional views of still another configuration of the heat-generator moving unit in the axial direction of the fixing device.
Figure 15B:
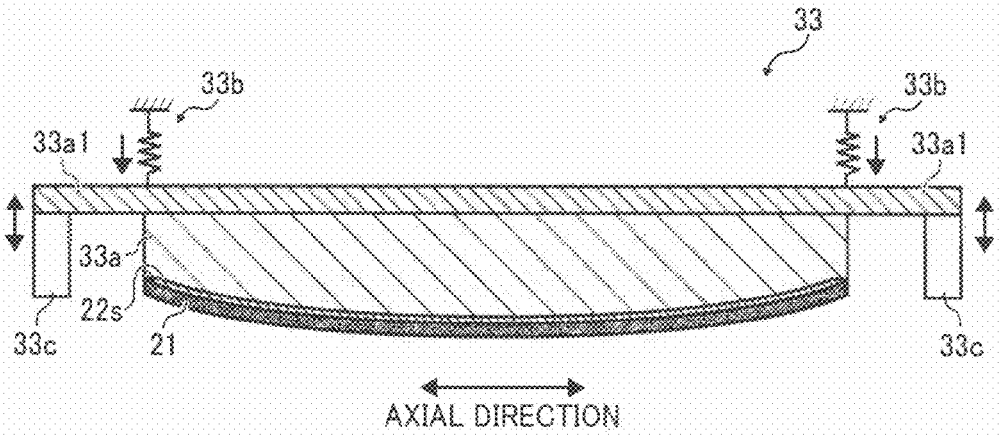

FIGS. 15A and 15B are schematic cross-sectional views of a configuration of the heat-generator moving unit 33 in the axial direction.

As illustrated in FIGS. 15A and 15B, for the heat-generator moving unit 33, a face of the heat-generator support member 33*a* that supports a heat generation sheet 22*s* is bent to have a difference in elevation in the thickness direction of the fixing sleeve 21 along the axial direction of the fixing sleeve 21. Specifically, the heat-generator support member 33*a* has an outer circumferential surface of a certain arc length along an inner circumferential surface of the fixing sleeve 21 having a circular cross-sectional shape in the circumferential direction (see FIG. 12). Further, as illustrated in FIGS. 15A and 15B, the outer circumferential surface of the heat-generator support member 33*a* has a convex shape in which an axial middle portion thereof is smoothly bent toward the inner circumferential surface of the fixing sleeve 21.

As a temperature detection unit that detects the temperature of certain points in the axial direction of the fixing sleeve 21, the heat-generator moving unit 33 includes a temperature sensor 33*s*1 that detects the surface temperature of an axial middle portion of the fixing sleeve 21 and temperature sensors 33*s*2 that detect the surface temperature of axial end portions of the fixing sleeve 21.

The function and material of the heat-generator support member 33*a* according to this exemplary embodiment are similar to, if not the same as, those of the heat-generator support member 33*a* illustrated in FIG. 12. Further, protrusions 33*a*1, leaf springs 33*b*, and driving cams 33*c* illustrated in FIGS. 15A and 15B are similar to, if not the same as, the protrusions 33*a*1, the leaf springs 33*b*, and the driving cams 33*c* illustrated in FIG. 12.

The heat-generator moving unit 33 adjusts the amount of movement of the heat-generator support member 33*a* and/or the heat generation sheet 22*s* to regulate a state of contact at which the heat generation sheet 22*s* contacts the fixing sleeve 21 in the axial direction of the fixing sleeve 21. Specifically, the following regulation changes the state of contact of the heat generation sheet 22*s* against the fixing sleeve 21. In this exemplary embodiment, the separating operation similar to that of the fixing device 20 illustrated in FIG. 12 can be performed.

[Contact Operation 2-1]

The driving cams 33*c* are rotated by a driving force of an external device (driving system) by a certain rotation angle in a clockwise direction in FIG. 12 so that the driving cams 33*c* support the protrusions 33*a*1 at a position (height position b) close to the fixing sleeve 21. At this time, since the leaf springs 33*b* push the protrusions 33*a*1 toward the fixing sleeve 21, the protrusions 33*a*1 move toward the fixing sleeve 21 and simultaneously, the heat-generator support member 33*a* moves toward the fixing sleeve 21. As a result, an axial middle portion of the heat generation sheet 22*s* supported by the outer circumferential surface of the heat-generator support member 33*a* contacts the inner circumferential surface of the fixing sleeve 21 (see FIG. 15A). In this state, the heat generation sheet 22*s* is in contact with the fixing sleeve 21 substantially without pressure. Axial end portions of the heat generation sheet 22*s* are separated from the inner circumferential surface of the fixing sleeve 21. For such a state of contact, a portion of the fixing sleeve 21 which contacts the heat generation sheet 22*s* is non-uniform in heat conduction efficiency and likely to cause non-uniform temperature distribution. By contrast, a portion of the heat generation sheet 22*s* that is separated from the fixing sleeve 21 may be subjected to excessive temperature increase, which is undesirable.

[Contact Operation 2-2*a*]

Then, the driving cams 33*c* are further rotated so that the driving cams 33*c* support the protrusions 33*a*1 at a position (height position C1) closer to the fixing sleeve 21 than the height position B. By a pressing force of the leaf springs 33*b*, the heat-generator support member 33*a* is moved to press against the inner circumferential surface of the fixing sleeve 21. As a result, an area of a certain width in the axial middle portion of the heat generation sheet 22*s* contacts the inner circumferential surface of the fixing sleeve 21 at a pressure greater than a threshold value. Such a configuration allows the heat generation sheet 22*s* to press against the fixing sleeve 21 at a pressure greater than a threshold value in a certain area of the middle portion of the heat generation sheet 22*s* in the axial direction of the fixing sleeve 21. As a result, the efficiency of heat transfer from the heat generation sheet 22*s* to the fixing sleeve 21 becomes substantially uniform in the certain area of the middle portion of the heat generation sheet 22*s* in the axial direction of the fixing sleeve 21, allowing a corresponding area of an axial middle portion of the fixing sleeve 21 to be heated in a uniform manner in the axial direction of the fixing sleeve 21.

Thus, good fixing performance and uniform image gloss can be obtained in the certain area of the axial middle portion of the fixing sleeve 21. By contrast, the heat generation sheet 22*s* contacts an area outside the certain area of the axial middle portion of the fixing sleeve 21 at a pressure lower than the threshold value. As a result, the efficiency of heat transfer from the heat generation sheet 22*s* to the fixing sleeve 21 becomes relatively low, and the heating of the certain area is suppressed, thus preventing excessive temperature increase.

The above-described certain area may be, for example, a minimum sheet-pass area. The minimum sheet-pass area used herein is an area having a width corresponding to a width of a recording medium P of a minimum size that the fixing device 20 can accommodate. For example, the minimum sheet-pass area has a width of 105 mm of a recording medium of A6 portrait size.

In the contact operation 2-2*a*, when the axial end portions of the heat generation sheet 22*s* are completely separated from the fixing sleeve 21, heat of the certain area of the heat generation sheet 22*s* may be not absorbed by the fixing sleeve 21, resulting in excessive temperature rising and subsequent failures. Hence, the end portions of the heat generation sheet 22*s* preferably contact the inner circumferential surface of the fixing sleeve 21 at such a low pressure that heat transferred from the end portions of the heat generation sheet 22*s* does not cause excessive temperature rising in the fixing sleeve 21. For such a configuration, a portion of the heat amount generated in the heat generation sheet 22*s* is absorbed by the fixing sleeve 21, preventing excessive temperature rise in both the fixing sleeve 21 and the heat generation sheet 22*s*.

Alternatively, the heat generation sheet 22*s* of FIG. 14A may be used in which the plurality of the resistant heat generation layers 22*b* is provided in the axial direction of the fixing sleeve 21 to generate heat independently. For such a configuration, in the contact operation 2-2*a*, when the axial end portions of the heat generation sheet 22*s* are completely separated from the fixing sleeve 21, power supply to the resistant heat generation layers 22*b*2 of the end portions may be stopped so as not to generate heat.

In addition, the heat-generator moving unit 33 preferably adjusts the amount of movement of the heat-generator support member 33*a* in accordance with the temperatures detected by the temperature sensor 33*s*1 and the temperature sensors 33*s*2 (FIG. 15A). In particular, the amount of movement of the heat-generator support member 33*a* is preferably adjusted in accordance with the difference between the temperature of the axial end portions of the fixing sleeve 21 (i.e., the detection temperature of the temperature sensor 33*s*2) and the temperature of the axial middle portion of the fixing sleeve 21 (i.e., the detection temperature of the temperature sensor 33*s*1). For example, in a case in which the detection temperature of the temperature sensor 33*s*2 is higher than the detection temperature of the temperature sensor 33*s*1 by a certain threshold amount, the heat-generator moving unit 33 moves the heat-generator support member 33*a* in a direction away from the fixing sleeve 21 at a certain distance. Thus, the pressure at which the axial end portions of the heat generation sheet 22*s* contact the inner circumferential surface of the fixing sleeve 21 is reduced. As a result, the efficiency of heat transfer from the axial end portions of the heat generation sheet 22*s* to the fixing sleeve 21 is reduced, thus securely preventing excessive temperature rising in the fixing sleeve 21.

[Contact Operation 2-2*b*]

Following the above-described contact operation 2-2*a*, the driving cams 33*c* are further rotated so that the driving cams 33*c* support the protrusions 33*a*1 at a position (height position C2) closer to the fixing sleeve 21 than the height position C1. By a pressing force of the leaf springs 33*b*, the heat-generator support member 33*a* is moved to press against the inner circumferential surface of the fixing sleeve 21. As a result, the heat generation sheet 22*s* contacts the inner circumferential surface of the fixing sleeve 21 at a pressure greater than a certain threshold value over the entire width of the heat generation sheet 22*s* in the axial direction of the fixing sleeve 21 (FIG. 15B).

Such a configuration allows the heat generation sheet 22*s* to press against the fixing sleeve 21 at a pressure greater than a threshold value over the entire width of the heat generation sheet 22*s* in the axial direction of the fixing sleeve 21. As a result, the efficiency of heat transfer from the heat generation sheet 22*s* to the fixing sleeve 21 becomes substantially uniform over the entire area in the axial direction of the fixing sleeve 21, allowing the fixing sleeve 21 to be heated in a uniform manner in the axial direction of the fixing sleeve 21. Thus, good fixing performance and uniform image gloss can be obtained over the entire area in the axial direction of the fixing sleeve 21, that is, a maximum sheet-pass area of the fixing sleeve 21.

The maximum sheet-pass area used herein is an area corresponding to a width of a recording medium P of a maximum size that passes the fixing device 20. For example, the maximum sheet-pass area may be a width of 300 to 350 mm of a recording medium of A4 landscape size (A3 portrait size).

As described above, the purpose of adjusting the state of contact of the heat generation sheet 22*s* against the fixing sleeve 21 is to prevent excessive temperature rising of the fixing sleeve 21. For this purpose, the axial pressure distribution in which the heat generation sheet 22*s* contacts the inner circumferential surface of the fixing sleeve 21 is adjusted, and the fixing area of the fixing sleeve 21 changed in accordance with the width of the recording medium P is heated to a fixing temperature by the heat generation sheet 22*s*. Further, the heat generation sheet 22*s* is configured to prevent heating of the non-sheet pass areas in the axial end portions of the fixing sleeve 21.

Therefore, the heat-generator moving unit 33 preferably adjusts the amount of movement (travel distance) of the heat-generator support member 33*a* in accordance with the width of the recording medium P through the driving of the driving cams 33*c* and holds the heat-generator support member 33*a* at a desired position between the height position C1 and the height position C2.

For example, assuming that, with the heat-generator support member 33*a* at the height position C2, the entire axial width of the heat generation sheet 22*s* contacts the inner circumferential surface of the fixing sleeve 21 at a pressure greater than a certain threshold value, and the fixing device is in a state compatible with the maximum size (e.g., the maximum sheet-pass area) of recording media to be conveyed. In such a state, when a recording medium P of an intermediate size (for example, B5 portrait size) between the maximum size (for example, A4 landscape) and the minimum size (for example, A6 portrait size) is conveyed to the fixing device in a subsequent fixing operation, the heat-generator moving unit 33 moves the heat-generator support member 33*a* from the height position C2 to the height position C1 at a certain distance. Thus, the heat-generator moving unit 33 performs the regulating operation to adjust the state of contact of the heat generation sheet 22*s* against the fixing sleeve 21 to deal with the intermediate-size recording medium P.

In other words, when the heat-generator support member 33*a* is at the height position C2, the heat generation sheet 22*s* contacts the inner circumferential surface of the fixing sleeve 21 over the entire axial width of the heat generation sheet 22*s* at a pressure greater than a threshold value PR. The inner circumferential surface of the fixing sleeve 21 is then heated by the heat generation sheet 22*s* over the entire axial width of the fixing sleeve 21 at a certain heat transfer efficiency k.

At this time, the pressure at which the heat generation sheet 22*s* contacts the inner circumferential surface of the fixing sleeve 21 correlates with the axial shape of the curved face of the heat-generator support member 33*a* facing the fixing sleeve 21. Specifically, the pressure is highest at the axial middle portion of the heat generation sheet 22*s*, gradually decreases toward the axial end portions of the heat generation sheet 22*s*, and is lowest (for example, the threshold pressure value PR) at each of the axial end portions. This relation is invariable regardless of the height position of the heat-generator support member 33*a*.

Accordingly, when the heat-generator support member 33*a* gradually moves from the height position C2 to the height position C1, the heat-generator support member 33*a* moves away from the inner circumferential surface of the heat-generator support member 33*a*. Simultaneously, from the axial end portions of the heat generation sheet 22*s*, the pressure at which the heat generation sheet 22*s* contacts the inner circumferential surface of the fixing sleeve 21 becomes lower than the threshold pressure value PR, which is required to secure the heat transfer efficiency k. Then, the area in which the pressure is lower than the threshold value PR gradually extends toward the axial middle portion of the heat generation sheet 22*s*. At the area in which the pressure is lower than the threshold value PR, the fixing sleeve 21 is not sufficiently heated, thus preventing good fixing performance. As a result, the axial width of the fixing sleeve 21 at which good fixing performance can be secured gradually reduces to the width corresponding to the (intermediate) size of the recording medium P, at which the heat-generator moving unit 33 stops moving of the heat-generator support member 33*a*. In this operation, the heat-generator moving unit 33 may move the heat-generator support member 33*a* in accordance with a previously-calculated amount of movement (or movement position) at which the heat-generator support member 33*a* reaches a position where the width of the fixing sleeve 21 at which good fixing performance can be secured is equal to the width corresponding to the size of the recording medium P.

For the above-described regulating operation, the heat-generator moving unit 33 adjusts the amount of movement of the heat-generator support member 33*a* in a direction toward the axial cross-sectional center of the fixing sleeve 21, allowing a desired width to be set as the axial contact width of the heat generation sheet 22*s* at which the heat generation sheet 22*s* contacts the inner circumferential surface of the fixing sleeve 21 at a pressure greater than a threshold value. Further, such a configuration can accommodate a given width of recording medium P in a range of from the minimum size to the maximum size and heat a proper area in a uniform manner while preventing excessive temperature rise in the area outside the width of the recording medium P to be conveyed.

It is to be noted that the shape of the heat-generator support member 33*a* is not limited to the shape illustrated in FIG. 15A. Thus, for example, FIGS. 16A to 16D illustrate other shapes of the heat-generator support member 33*a*. In FIGS. 16A to 16D, the heat-generator support member 33*a* has a curved face having a difference in elevation in the thickness direction of the fixing sleeve 21 along the axial direction of the fixing sleeve 21 to support the heat generation sheet 22*s* and an outer circumferential surface of a certain arc length along an inner circumferential surface of the fixing sleeve 21 having a circular cross-sectional shape in the circumferential direction (see FIG. 12).

Figure 16A:
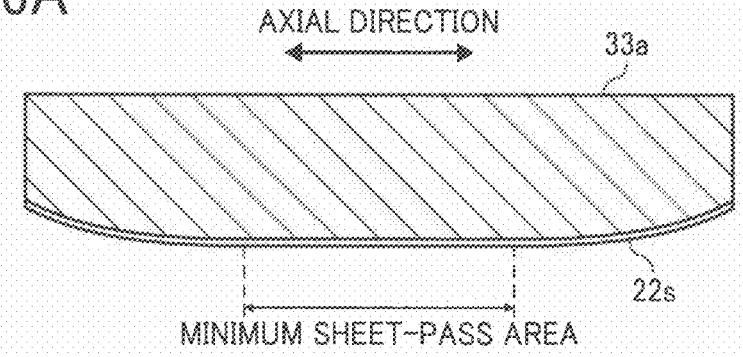
FIGS. 16A to 16D are schematic cross-sectional views of a heat-generator support member in the axial direction of the fixing device.

The heat-generator support member 33*a* may have an outer circumferential surface of a drum shape illustrated in FIG. 16A. In the outer circumferential surface, an area of a width corresponding to the minimum sheet-pass area in the axial middle portion of the heat-generator support member 33*a* is parallel to the inner circumferential surface of the fixing sleeve 21, and curved areas are smoothly bent from the axial middle portion toward the axial end portions so as to gradually go away from the inner circumferential surface of the fixing sleeve 21.

Figure 16B:
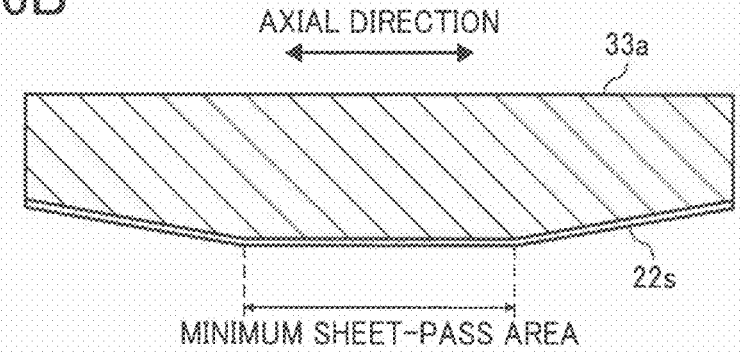

The heat-generator support member 33*a* may have an outer circumferential surface of a drum shape illustrated in FIG. 16B. In the outer circumferential surface, an area of a width corresponding to the minimum sheet-pass area in the axial middle portion of the heat-generator support member 33*a* is parallel to the inner circumferential surface of the fixing sleeve 21, and slope areas are gently inclined from the axial middle portion toward the axial end portions so as to gradually go away from the inner circumferential surface of the fixing sleeve 21.

For the heat-generator support member 33*a* illustrated in FIGS. 16A and 16B, the above-described contact operation 2-2*a* causes the heat generation sheet 22*s* to press against the fixing sleeve 21 at a pressure greater than a threshold value in the width area corresponding to the minimum sheet-pass area in the middle portion of the heat generation sheet 22*s* in the axial direction of the fixing sleeve 21. As a result, the efficiency of heat transfer from the heat generation sheet 22*s* to the fixing sleeve 21 becomes substantially uniform in the width area of the middle portion of the heat generation sheet 22*s* in the axial direction of the fixing sleeve 21. Thus, an area corresponding to the minimum sheet-pass area in an axial middle portion of the fixing sleeve 21 can be heated in a uniform manner in the axial direction of the fixing sleeve 21. Thus, good fixing performance and uniform image gloss can be obtained for the minimum-size recording medium P while preventing excessive temperature rising in an area outside the area corresponding to the minimum sheet-pass area of the fixing sleeve 21. Further, the above-described contact operation 2-2*b* causes the entire axial width of the heat generation sheet 22*s* to press against the inner circumferential surface of the fixing sleeve 21 at a pressure greater than a threshold value. Thus, good fixing performance and uniform image gloss can be obtained in the entire axial area, that is, the maximum sheet-pass area of the fixing sleeve 21. Further, the regulating operation of the heat-generator moving unit 33 allows the fixing device to deal with a given width of recording medium P in a range of from the minimum size to the maximum size and heat a proper area in a uniform manner while preventing excessive temperature rise in the area outside the width of the recording medium P to be conveyed.

Figure 16C:
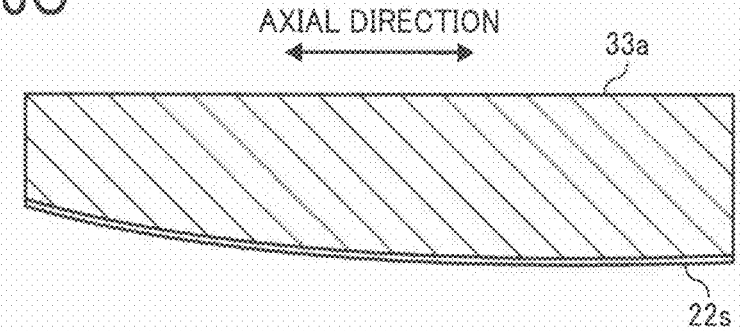

The heat-generator support member 33*a* may have an outer circumferential surface of a drum shape illustrated in FIG. 16C. In the outer circumferential surface, an area of a width corresponding to the minimum sheet-pass area in the axial middle portion of the heat-generator support member 33*a* is parallel to the inner circumferential surface of the fixing sleeve 21, and slope areas are gently inclined from the axial middle portion toward the axial end portions so as to gradually go away from the inner circumferential surface of the fixing sleeve 21.

Figure 16D:
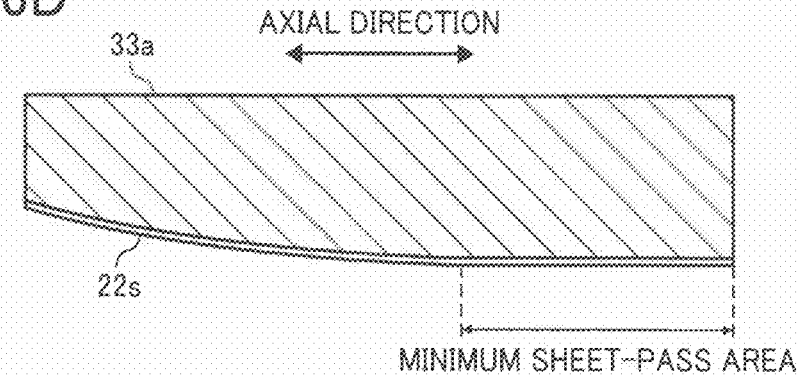

The heat-generator support member 33*a* may have an outer circumferential surface of a drum shape illustrated in FIG. 16D. In the outer circumferential surface, an area of a width corresponding to the minimum sheet-pass area in one end portion of the heat-generator support member 33*a* in the axial direction of the fixing sleeve 21 is parallel to the inner circumferential surface of the fixing sleeve 21, and curved areas are smoothly bent from the one end portion toward the other end portion so as to gradually go away from the inner circumferential surface of the fixing sleeve 21.

For the heat-generator support member 33*a* illustrated in FIGS. 16C and 16D, the above-described contact operation 2-2*a* causes the heat generation sheet 22*s* to press against the fixing sleeve 21 at a pressure greater than a threshold value in a width area corresponding to a certain area (e.g., the minimum sheet-pass area in FIG. 16D) extending from the one end portion (e.g., the right-side end portion in FIG. 16D) of the heat generation sheet 22*s* in the axial direction of the fixing sleeve 21. As a result, the efficiency of heat transfer from the heat generation sheet 22*s* to the fixing sleeve 21 becomes substantially uniform in the width area of the heat generation sheet 22*s* in the axial direction of the fixing sleeve 21. Thus, an area of the fixing sleeve 21 corresponding to the certain area (e.g., the minimum sheet-pass area) extending from the one end portion of the heat generation sheet 22*s* in the axial direction of the fixing sleeve 21 can be heated in a uniform manner in the axial direction of the fixing sleeve 21. Thus, good fixing performance and uniform image gloss can be obtained for the minimum-size recording medium P while preventing excessive temperature rising in an area outside the area corresponding to the minimum sheet-pass area of the fixing sleeve 21. Further, the above-described contact operation 2-2*b* causes the entire axial width of the heat generation sheet 22*s* to press against the inner circumferential surface of the fixing sleeve 21 at a pressure greater than a threshold value. Thus, good fixing performance and uniform image gloss can be obtained in the entire axial area, that is, the maximum sheet-pass area of the fixing sleeve 21. Further, the regulating operation of the heat-generator moving unit 33 allows the fixing device to deal with a given width of recording medium P in a range of from the minimum size to the maximum size and heat a proper area in a uniform manner while preventing excessive temperature rising in the area outside the width of the recording medium P to be conveyed.

In this regard, for the fixing device 20 illustrated in FIG. 12, during rotation, the fixing sleeve 21 is pulled by the pressing roller 31 at the nip N. As a result, tension acts on the fixing sleeve 21 at the upstream side of the nip N in the rotation direction R5 of the fixing sleeve 21. Thus, with the inner circumferential surface of the fixing sleeve 21 pressed against the heat-generator support member 33*a*, the inner circumferential surface of the fixing sleeve 21 slides against the heat generation sheet 22*s*. Meanwhile, the fixing sleeve 21 receives no tension at the downstream side of the nip N in the rotation direction R5 of the fixing sleeve 21, and as a result, is relaxed. In this state, if the speed of the fixing operation is increased, the fixing sleeve 21 might be further relaxed, causing a failure in the stability of the rotational running of the fixing sleeve 21. Further, if the fixing sleeve 21 approaches the heat-generator support member 33*a* with the fixing sleeve 21 relaxed, the state of contact of the heat generation sheet 22*s* against the fixing sleeve 21 might get unstable.

Figure 17:
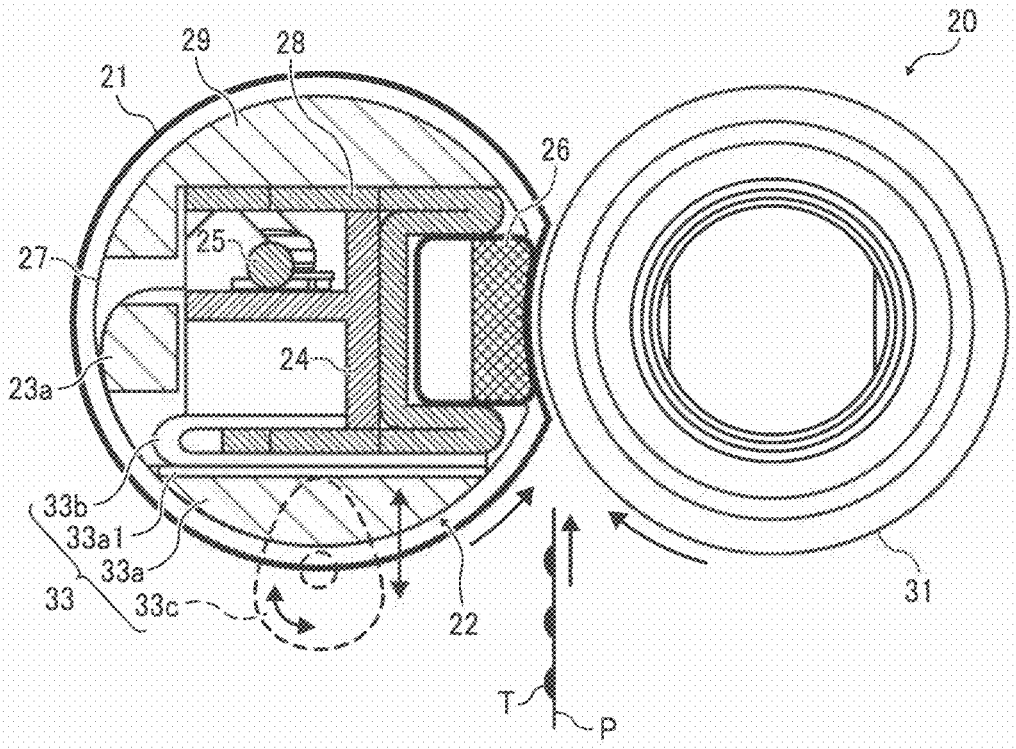
FIG. 17 is a cross-sectional view of a fixing device according to an exemplary embodiment of the present disclosure.

Hence, as illustrated in FIG. 17, the fixing device 20 preferably has a rotation support member 27 that supports the rotational state of the fixing sleeve 21 at the inner circumferential side of the fixing sleeve 21 at the downstream side of the nip N.

FIG. 17 is a cross sectional view of a configuration of a fixing device 20 according to an exemplary embodiment.

The fixing device 20 illustrated in FIG. 17 differs from the fixing device illustrated in FIG. 12 in that the fixing device 20 illustrated in FIG. 17 includes the rotation support member 27 and an insulation support member 29. Other components and configuration are similar to, if not the same as, those of the fixing device illustrated in FIG. 12, and descriptions thereof are omitted below.

The rotation support member 27 has a pipe shape and is made of a thin metal, such as iron or stainless, of a thickness of, for example, approximately 0.1 mm to approximately 1 mm. The outer diameter of the rotation support member 27 is smaller than the inner diameter of the fixing sleeve 21 by, for example, approximately 0.5 mm to approximately 1 mm. The inner circumferential surface of the fixing sleeve 21 contacts the outer circumferential surface of the rotation support member 27 over an area from at least a position distal to the nip to a position proximal to an entry of the nip in the outer circumferential surface of the rotation support member 27. A portion of the outer circumferential surface of the rotation support member 27 is cut near the nip N along the axial direction of the fixing sleeve 21 to form as an opening. End portions of the outer circumferential surface of the rotation support member 27 are folded toward a core support member 28 so as not to contact the nip N.

Figure 18:
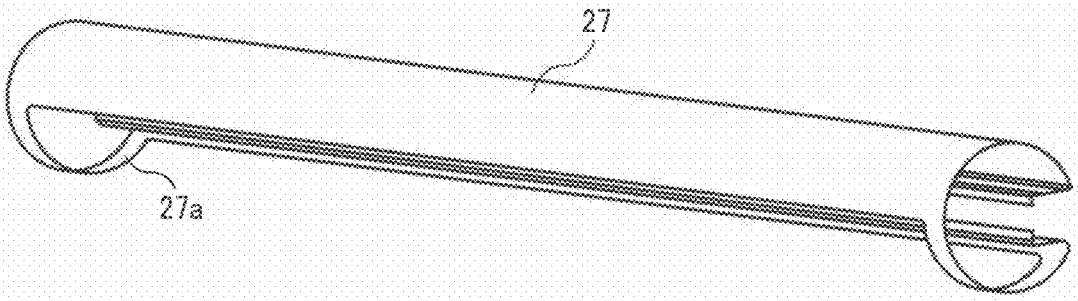
FIG. 18 is a perspective view of a rotation support member.

As illustrated in FIG. 18, for the rotation support member 27, a certain area of the outer circumferential surface upstream the nip N is removed to form an opening 27*a*. Thus, when an internal mechanical section of the fixing sleeve 21 is formed, the whole surface of the heat generation sheet 22*s* exposes from the opening 27*a*. When the heat-generator support member 33*a* is moved by the heat-generator moving unit 33, the surface of the heat generation sheet 22*s* is positioned on the same trajectory as the outer circumferential surface of the rotation support member 27 or at a position slightly protruding from the outer circumferential surface of the rotation support member 27. Thus, the heat generation sheet 22*s* contacts the inner circumferential surface of the fixing sleeve 21.

As a result, the planar heat generator 22 (the heat generation sheet 22*s*) is supported by the heat-generator support member 33*a* in contact with the inner circumferential surface of the fixing sleeve 21, allowing efficient heating of the fixing sleeve 21.

The end portions of the rotation support member 27 formed by cutting a portion of the outer circumferential face along the axial direction are hooked by the core-support member 28 around the nip in the circumferential direction. Thus, the position of the rotation support member 27 is maintained. Further, the ends of the rotation support member 27 in the axial direction are held by side plates constituting a frame of the fixing device 20.

The insulation support member 29 has a heat resistance enough to withstand the heat of the fixing sleeve 21 transferred via the rotation support member 27, a thermal insulation performance to prevent heat outflow (loss) from the rotation support member 27 in contact with the fixing sleeve 21, and a strength enough to support the rotation support member 27 without deformation when the fixing sleeve 21 rotated contacts the rotation support member 27. For example, the insulation support member 29 is preferably a molded foam of polyimide resin.

As described above, for this configuration, the rotation stability of the fixing sleeve 21 is secured by the rotation support member 27, and the fixing sleeve 21 is supported by the rotation support member 27 of high rigidity including metal, thus allowing easy handling in assembling.

As described above, the image forming apparatus 1 illustrated in FIG. 3 includes the fixing device 20 described above. Such a configuration can reduce the warm-up time and the first print time, achieve an excellent fixing performance in the axial direction, and obtain uniform image gloss. In addition, the image forming apparatus 1 can perform excellent image formation on different sizes of recording media P while preventing excessive temperature rising at an area of the fixing member through which a recording medium P does not pass.

Numerous additional modifications and variations are possible in light of the above teachings. It is therefore to be understood that within the scope of the appended claims, the present disclosure may be practiced otherwise than as specifically described herein. With some embodiments having thus been described, it will be obvious that the same may be varied in many ways.

For example, the number, position, and shape of the components are not limited to the above-described exemplary embodiments and may be any other suitable number, position, and shape may be used. Further, elements and/or features of different exemplary embodiments may be combined with each other and/or substituted for each other within the scope of this disclosure and appended claims. Such variations are not to be regarded as a departure from the scope of the present disclosure and appended claims, and all such modifications are intended to be included within the scope of the present disclosure and appended claims.

What is claimed is:

1. A heat conduction unit comprising:

a flexible endless belt;

a heat conductor disposed in proximity to an inner circumferential face of the endless belt and having a cross-section substantially identical to a cross-section of the endless belt;

a heat source that heats the heat conductor to heat the endless belt;

a pressing roller disposed opposite the heat conductor to rotate the endless belt in accordance with rotation of the pressing roller;

a nip formation member disposed opposite the pressing roller and within a loop formed by the endless belt, to form a nip between the endless belt and the pressing roller; and a pushing member disposed within the loop formed by the endless belt to support the nip formation member, wherein the heat conductor has at least two different cross-sectional shapes perpendicular to a long direction of the heat conductor at different positions in the long direction of the heat conductor.

2. The heat conduction unit according to claim 1, wherein the at least two different cross-sectional shapes of the heat conductor gradually change symmetrically with respect to a middle portion of the heat conductor.

3. The heat conduction unit according to claim 1, wherein the at least two different cross-sectional shapes of the heat conductor are deformable in accordance with a size of a recording medium transported to the heat conduction unit.

4. The heat conduction unit according to claim 1, further comprising a temperature detector that detects a temperature of the endless belt, wherein, in accordance with the detected temperature, a cross-sectional shape of the heat conductor at one end portion thereof and a cross-sectional shape of the heat conductor at another end portion thereof are deformed independently.

5. The heat conduction unit according to claim 1, wherein the heat source is an electromagnetic induction heater that generates heat by electromagnetic induction.

6. A fixing device comprising a heat conduction unit according to claim 1.

7. An image forming apparatus comprising a fixing device according to claim 6.

8. A fixing device comprising:

an endless-shaped rotational fixing member;

a pressing member pressed against an outer circumferential face of the fixing member;

a contact member disposed inside the fixing member to contact the pressing member with the fixing member interposed between the contact member and the pressing member to form a nip;

a planar heat generator disposed so as to be contactable with an inner circumferential face of the fixing member to heat the fixing member; and a heat generator moving unit including a movable heat generator support member, wherein the heat generator support member is disposed inside the fixing member so as to sandwich the planar heat generator between the heat generator support member and the fixing member to support the planar heat generator, wherein the heat generator moving unit moves the heat generator support member in a direction to push or separate the heat generator support member against or from the inner circumferential face of the fixing member to press or separate the planar heat generator against or from the fixing member, wherein the heat generator support member has a curved or slanted face supporting the planar heat generator, the curved or slanted face having a level difference in a thickness direction of the fixing member at different positions in an axial direction of the fixing member, and wherein the heat generator moving unit adjusts an amount of movement by which the heat generator support member moves to adjust a state of contact of the fixing member against the planar heat generator in the axial direction of the fixing member.

9. The fixing device according to claim 8, wherein, in operation, the planar heat generator is pressed against the inner circumferential face of the fixing member by the heat generator moving unit.

10. The fixing device according to claim 8, wherein the heat generator moving unit adjusts the amount of movement of the heat generator support member in accordance with a width of a recording medium.

11. The fixing device according to claim 8, further comprising a temperature detector that detects a temperature in the axial direction of the fixing member, wherein the heat generator moving unit adjusts the amount of movement of the heat generator support member in accordance with the temperature detected by the temperature detector.

12. The fixing device according to claim 8, wherein the planar heat generator includes a flexible heat-generation sheet comprising:

an insulative base layer;

a resistant heat generation layer disposed on the insulative base layer, and including a heat resistant resin and conductive particles dispersed in the heat resistant resin; and an electrode layer disposed on the resistant heat generation layer to supply power to the resistant heat generation layer, wherein the heat generation sheet has a width and length corresponding to an axial width and circumferential length of the fixing member.

13. The fixing device according to claim 8, further comprising a rotational support member disposed inside the fixing member and downstream of the nip in a rotation direction of the fixing member to support a rotation state of the fixing member.

14. An image forming apparatus comprising a fixing device according to claim 8.

* * * * *